US007963320B2

(12) United States Patent
Schnepf

(10) Patent No.: US 7,963,320 B2
(45) Date of Patent: Jun. 21, 2011

(54) COVER ASSEMBLY FOR FLANGES AND OTHER TUBULAR MEMBERS

(76) Inventor: Corey Schnepf, Red Deer (CA)

( * ) Notice: Subject to any disclaimer, the term of this patent is extended or adjusted under 35 U.S.C. 154(b) by 0 days.

(21) Appl. No.: 12/210,162

(22) Filed: Sep. 12, 2008

(65) Prior Publication Data

US 2010/0064589 A1 Mar. 18, 2010

(51) Int. Cl.
*E21B 33/02* (2006.01)

(52) U.S. Cl. ..... 166/92.1; 166/75.13

(58) Field of Classification Search ..... 166/92.1, 166/94.1, 93.1, 75.13, 97.1
See application file for complete search history.

(56) References Cited

U.S. PATENT DOCUMENTS 941,452 A * 11/1909 Henning ..... 220/288
4,848,458 A * 7/1989 Holdsworth et al. ..... 166/92.1
4,881,597 A * 11/1989 Hensley ..... 166/92.1
5,184,608 A * 2/1993 Hale, III ..... 138/89
5,784,887 A * 7/1998 Chow et al. ..... 60/657
6,105,669 A * 8/2000 Davis ..... 166/75.13
7,658,570 B2 * 2/2010 Hill et al. ..... 404/25
2003/0222045 A1 * 12/2003 Shane ..... 215/230

* cited by examiner

*Primary Examiner* — William P Neuder
(74) *Attorney, Agent, or Firm* — Sander Gelsing

(57) ABSTRACT

A cover assembly for use on a wide variety of tubular members comprises a base member, a pivoting member, a plurality of fingers extending from both the base member and the pivoting member and pivot means to pivotally join said pivoting member to said base member. Preferably the cover assembly is pivotable between an open configuration and a closed configuration, wherein said open configuration accepts a first bolt pattern configuration and wherein said closed configuration accepts a second bolt pattern configuration. More preferably, the cover assembly further comprises a ring groove guide. Even more preferably, the cover assembly further comprises a tubular engagement member.

16 Claims, 21 Drawing Sheets

COVER ASSEMBLY FOR FLANGES AND OTHER TUBULAR MEMBERS

FIELD OF THE INVENTION

The present invention relates generally to covers and, more particularly, to adjustable cover assemblies for fitting a variety of different tubular members.

BACKGROUND OF THE INVENTION

In an oil or gas well setting an exposed, or open, generally upward facing tubular member, such as a flange or pipe, is a common occurrence. Often such a tubular member provides direct access to the oil or gas well itself, or to some of the wellhead equipment. Such an opening, even if uncovered for a relatively short period of time, creates the potential for foreign objects to accidentally enter the well or wellhead equipment, causing safety concerns and potential down time of the well. As such, there is often a need to have a cover for such a generally upwardly faced tubular member.

To complicate matters, a variety of differently sized flanges or other tubular members, such as casing bowls, tubing hangers, well heads, spools, valves, blowout preventers (BOPs) and other wellhead and Christmas tree equipment, may be employed between different well sites or during different stages of well drilling, well operation or well servicing. For example, common types of tubular member inside diameters include 13⅝ inch, 11 inch and 7 1/16 inch bore American Petroleum Institute (API) 6A flanges.

To complicate matters even further, the exposed ends of tubular members may be flanged or non-flanged, studded (such as with stud bolts or tap end stud bolts) or non-studded with bolt openings to accept such studded members. Different bolt pattern configurations, such as 12 bolt or 16 bolt patterns, are also commonly used, in oil field applications.

The variable dimensions of tubular members, the presence or absences of stud members and the different bolt pattern configurations, make it difficult to design a single cover that will be suitable for most or all of the tubular members commonly encountered in an oil or gas well application. Accordingly, a need exists in the art for a cover that fits a variety of such different tubular members.

SUMMARY OF THE INVENTION

The present invention provides improvements to tubular member covers. In one embodiment, the present invention provides a cover assembly for a tubular member comprising a base member, a pivoting member, a plurality of fingers extending from both the base member and the pivoting member and pivot means to pivotally join said pivoting member to said base member.

In another aspect of the invention there is provided a cover assembly for a tubular member pivotable between an open configuration and a closed configuration, wherein said open configuration accepts a first bolt pattern and wherein said closed configuration accepts a second bolt pattern.

BRIEF DESCRIPTION OF THE DRAWINGS

Embodiments of the invention will now be described, by way of example only, with reference to the accompanying drawings, wherein.

DETAILED DESCRIPTION OF THE PREFERRED EMBODIMENTS

Figure 1A:
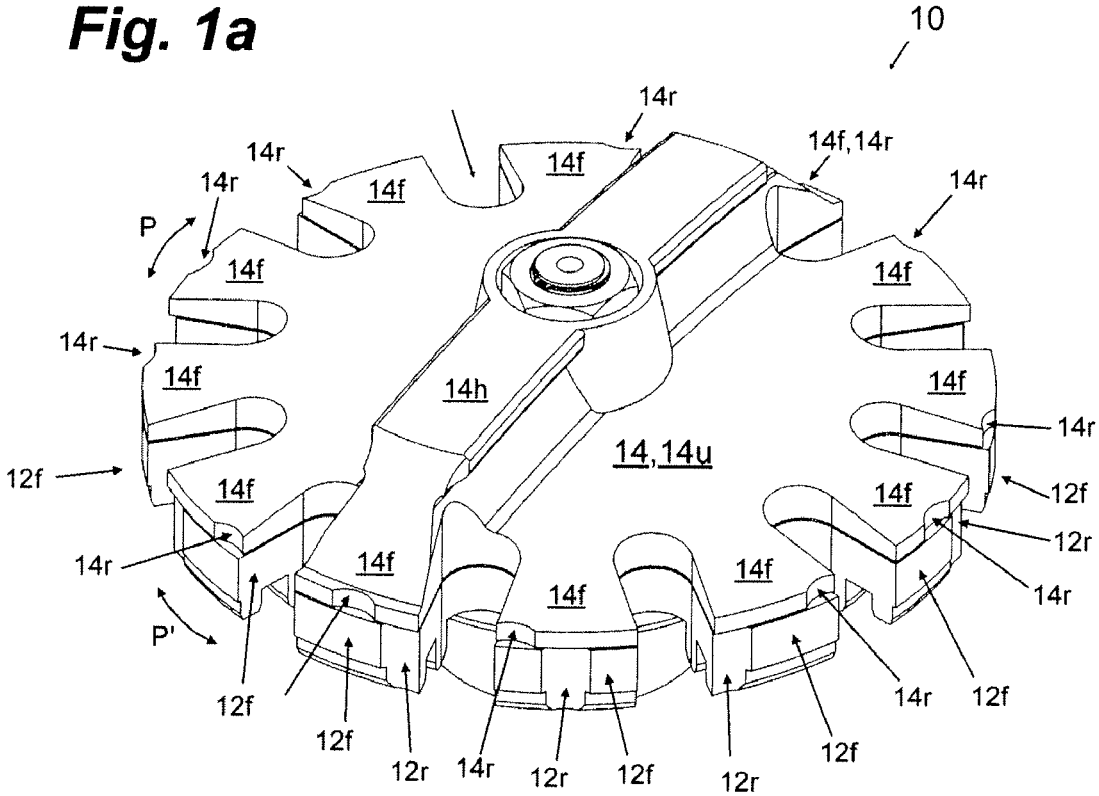
FIG. 1*a* is a top perspective view of a cover assembly according to a preferred embodiment of the invention, shown in a first bolt pattern configuration.
Figure 1B:
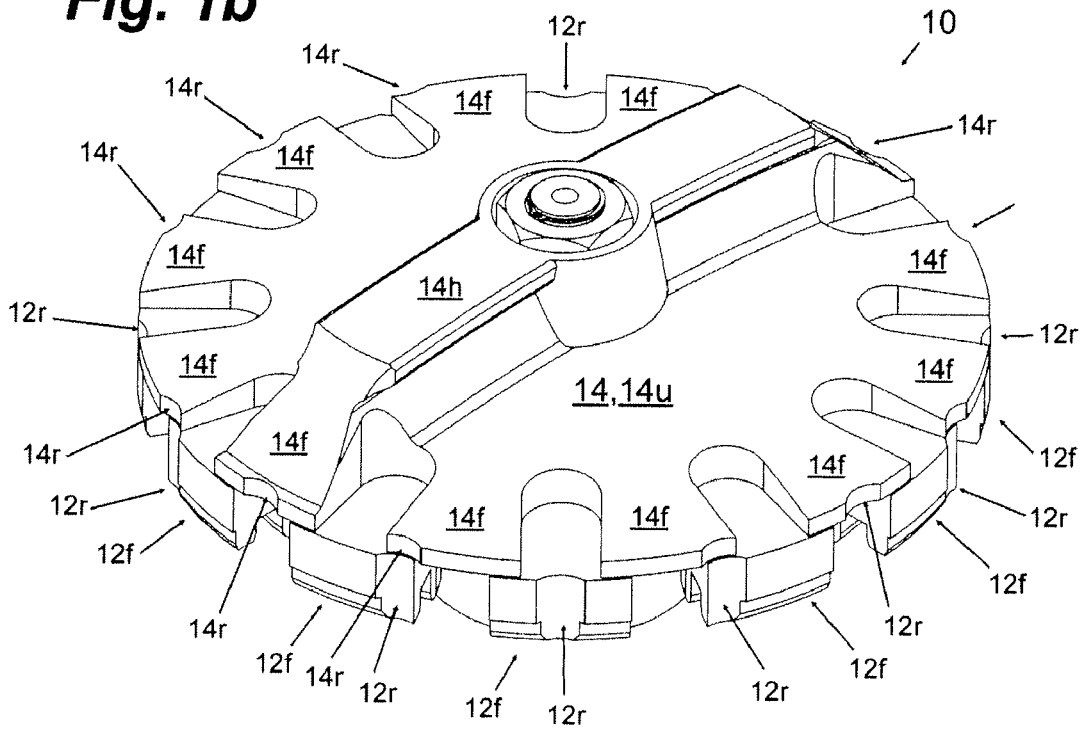
FIG. 1*b* is a top perspective view of the cover assembly of FIG. 1*a*, shown in a second bolt pattern configuration.
Figure 2A:
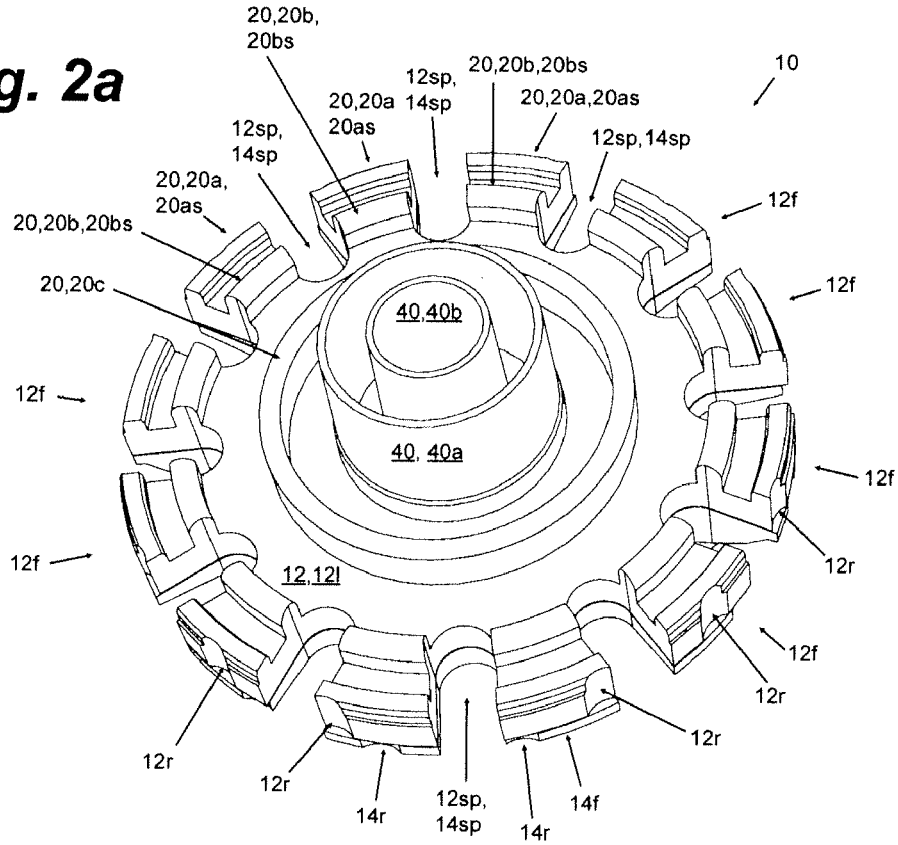
FIG. 2*a* is bottom perspective view of the cover assembly of FIG. 1*a*, shown in the first bolt pattern configuration.
Figure 2B:
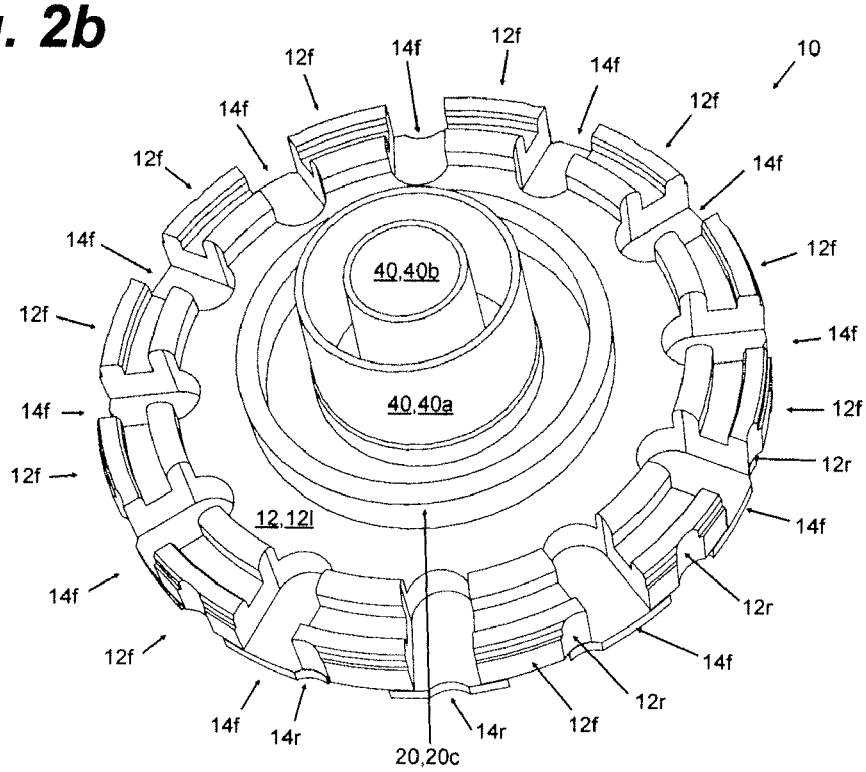
FIG. 2*b* is a bottom perspective view of the cover assembly of FIG. 1*a*, shown in the second bolt pattern configuration.
Figure 3A:
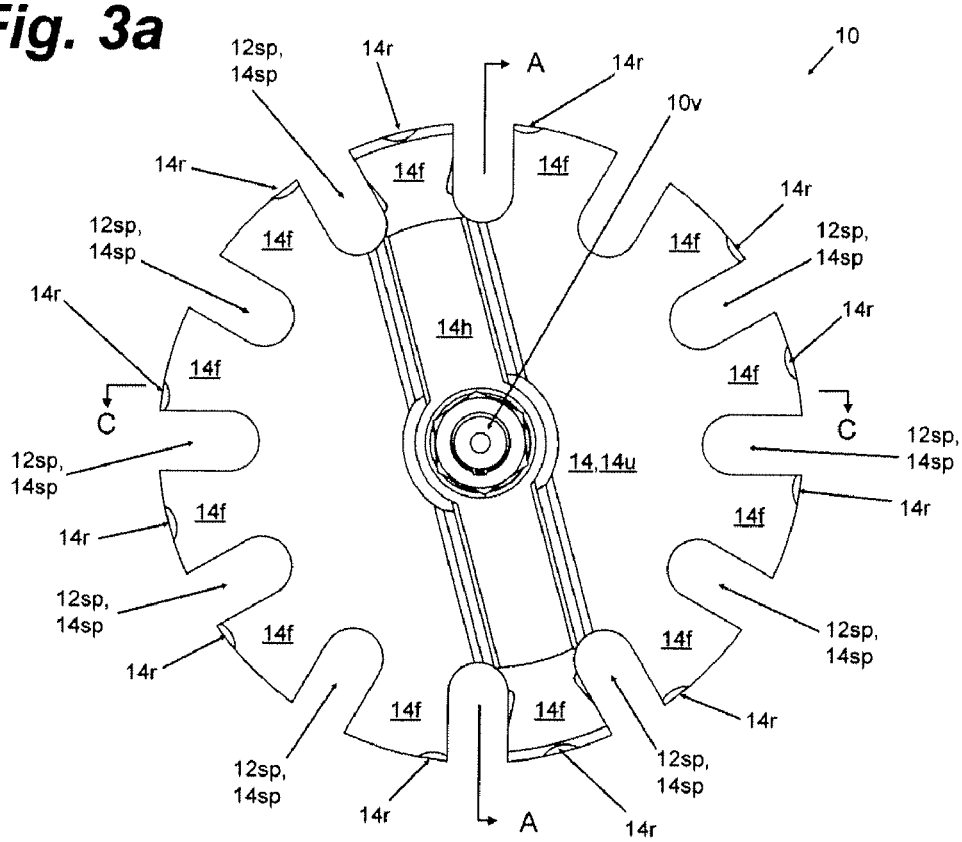
FIG. 3*a* is a top view of the cover assembly of FIG. 1*a*, shown in a first bolt pattern configuration.
Figure 3B:
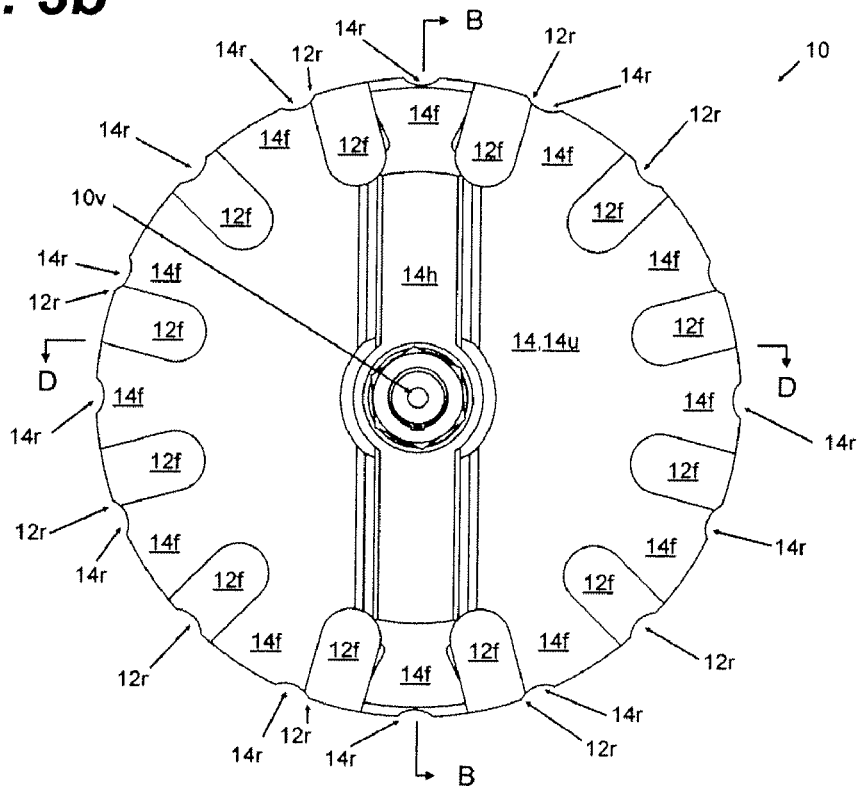
FIG. 3*b* is a top view of the cover assembly of FIG. 1*a*, shown in a second bolt pattern configuration.
Figure 4A:
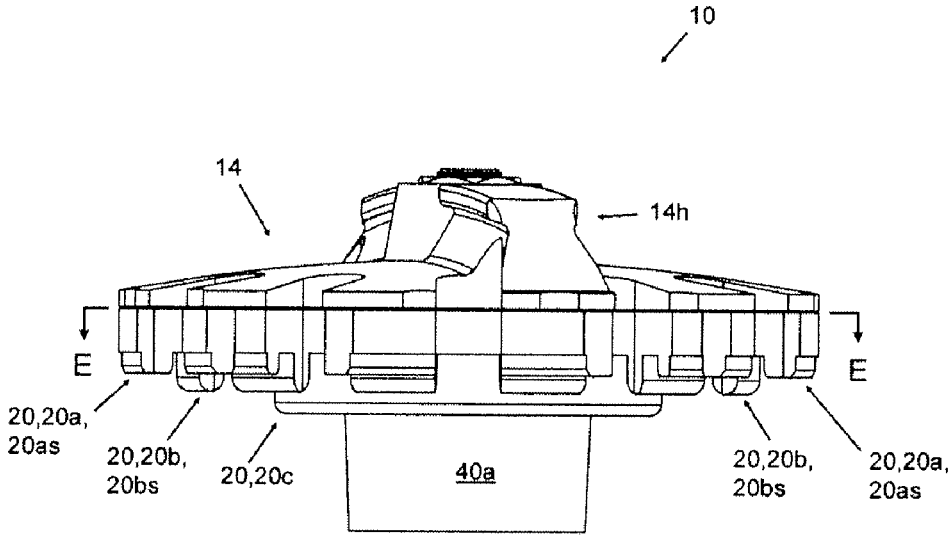
FIG. 4*a* is a side view of the cover assembly of FIG. 1*a*, shown in a first bolt pattern configuration.
Figure 4B:
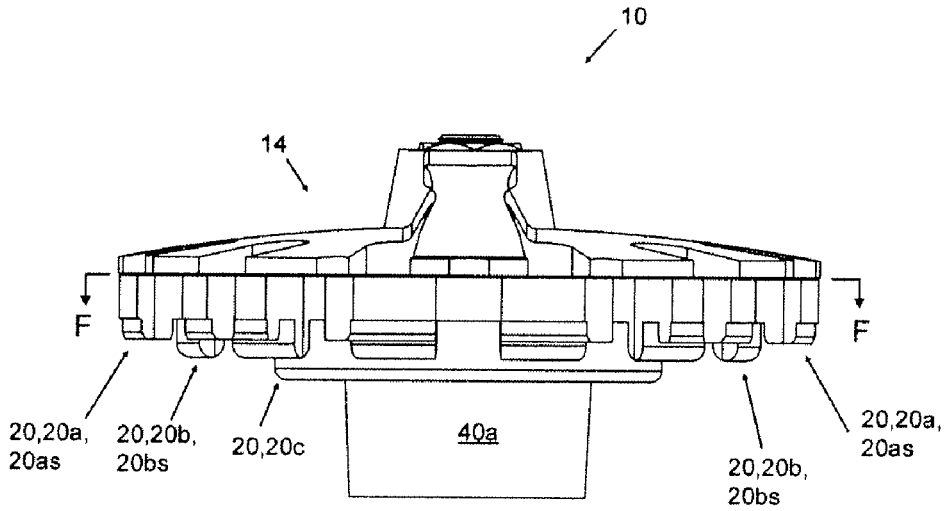
FIG. 4*b* is a side view of the cover assembly of FIG. 1*a*, shown in a second bolt pattern configuration.

The following description are of a preferred embodiment by way of example only and without limitation to the combination of features necessary for carrying the invention into effect. Reference is to be had to the Figures in which identical reference numbers identify similar components. The drawing figures are not necessarily to scale and certain features are shown in schematic form in the interest of clarity and conciseness.

FIGS. 1*a*-9*m* illustrates one embodiment of the present invention. In this embodiment, cover assembly 10 for covering a tubular member 11 comprises a base member 12 and a pivoting member 14. Base member 12 and pivoting member 14 are pivotally joined together by pivot means 16 so as to allow base member 12 and pivoting member 14 to co-axially pivot relative to each other (as indicated by arrows P and P' respectively).

Preferably, base member 12 and pivoting member 14 each are of generally planar or flat configuration having a circular profile when viewed from the top or bottom. More preferably, base member 12 and pivoting member 14 each having an upper surface 12*u*, 14*u* and a lower surface 12*l*, 14*l* wherein the upper surface 12*u* of the base member 12 is in abutting relation with the lower surface 14*l* of the pivoting member 14 (see FIG. 5*c*). Even more preferable, the upper surface 14*u* of the pivoting member 14 further comprises a handle 14*h* on its upper surface 14*u* to facilitate ease of pivoting of the pivoting member 14 relative to the base member 12. Yet even more preferably, the cover assembly further comprises a small vent opening 10*v* to prevent a pressure build up which might dislodge the cover assembly 10 from a tubular member 11 upon which it is placed. Advantageously, the small vent opening 10*v* may also be used as a sample point for detectors used in the oilfield industry to sense the presence of hydrogen sulphide ($H_2S$). Yet even more preferably, the base member 12 and the pivoting member are constructed of an elastomer, rubber or thermoplastic material.

Figure 5A:
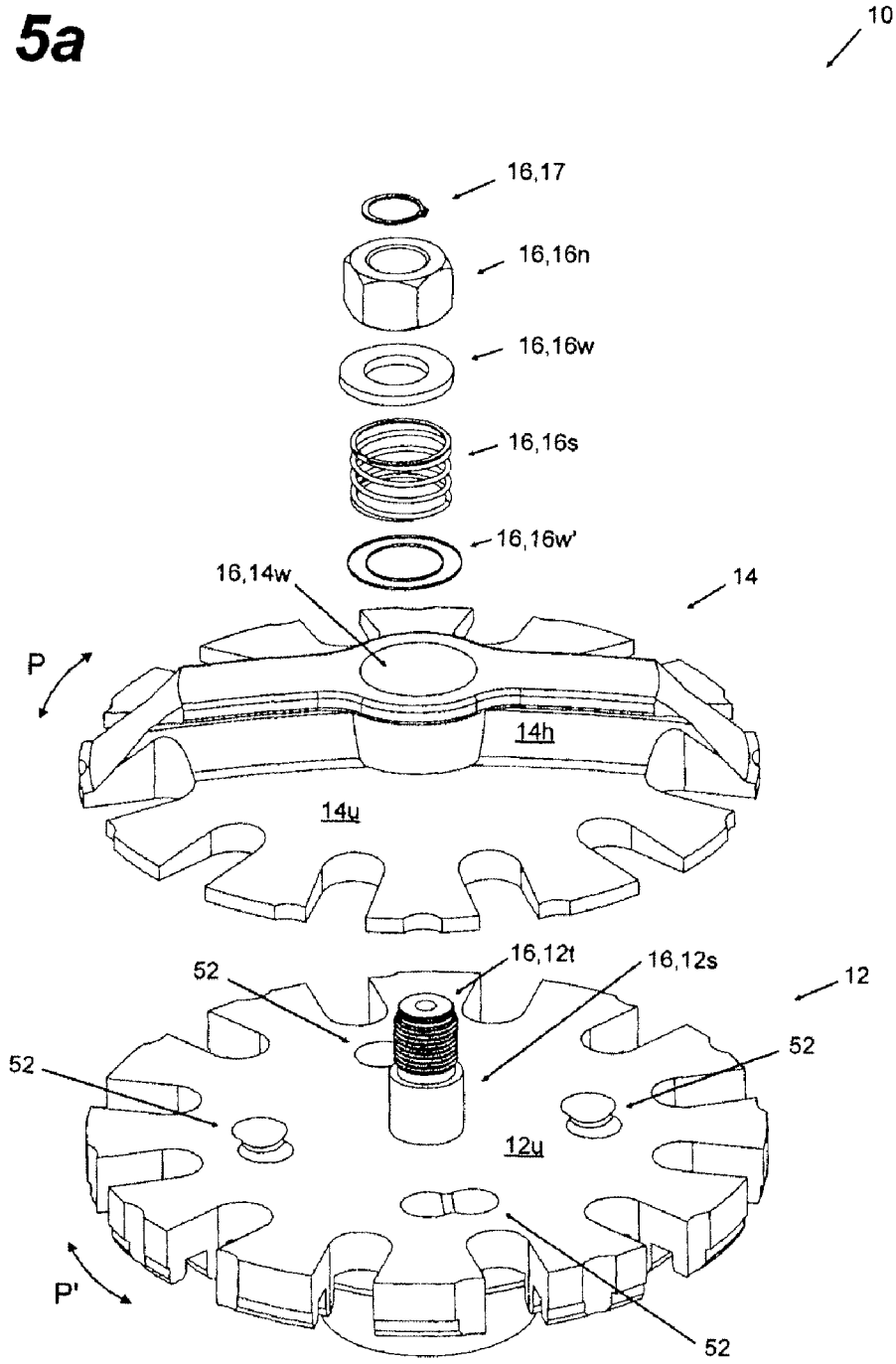
FIG. 5*a* is an exploded perspective view of the cover assembly of FIG. 1*a;*
Figure 5B:
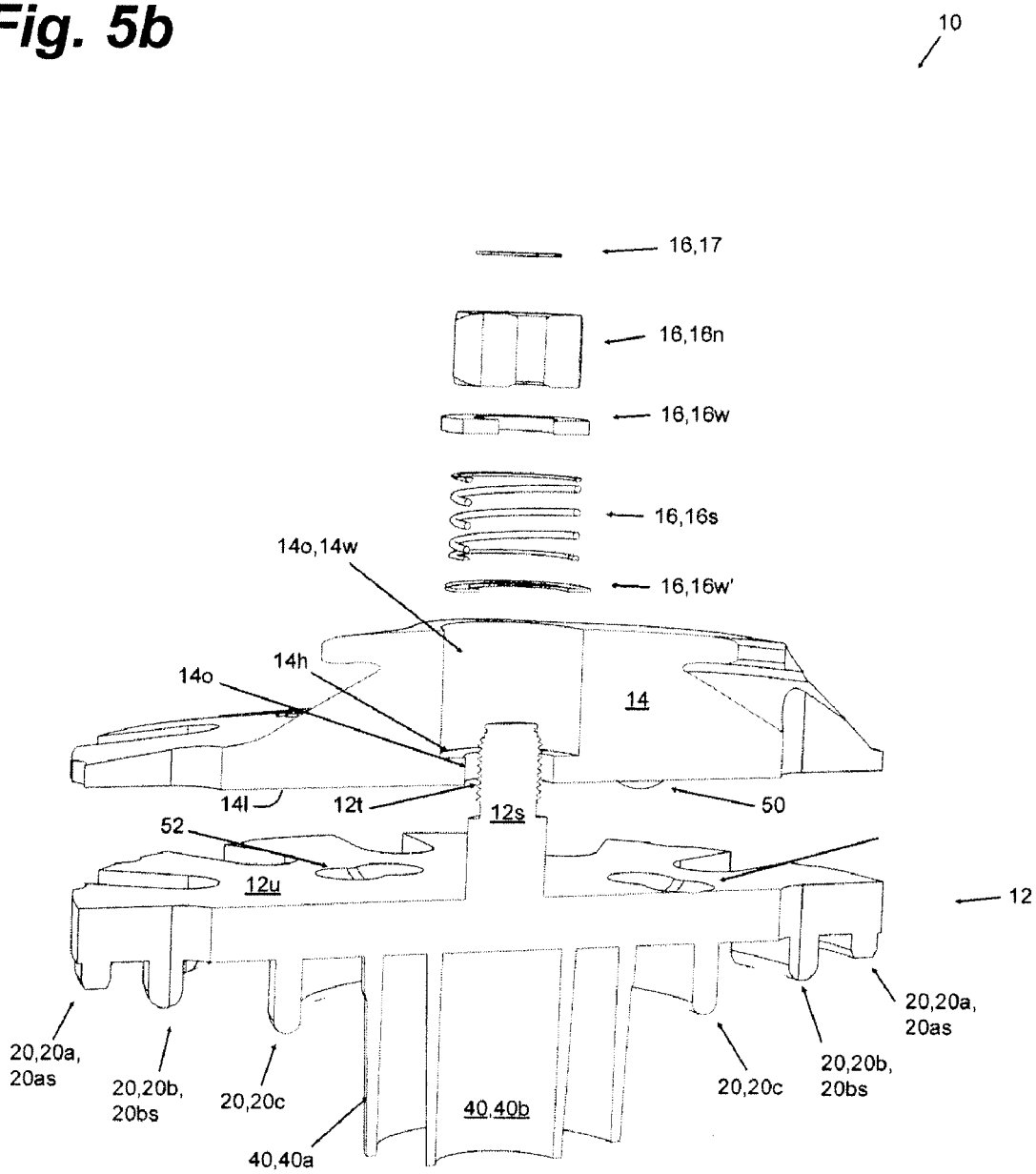
FIG. 5*b* is a cross-sectional exploded perspective view of the cover assembly of FIG. 1*a* taken along line A-A in FIG. 3*a*
Figure 5C:
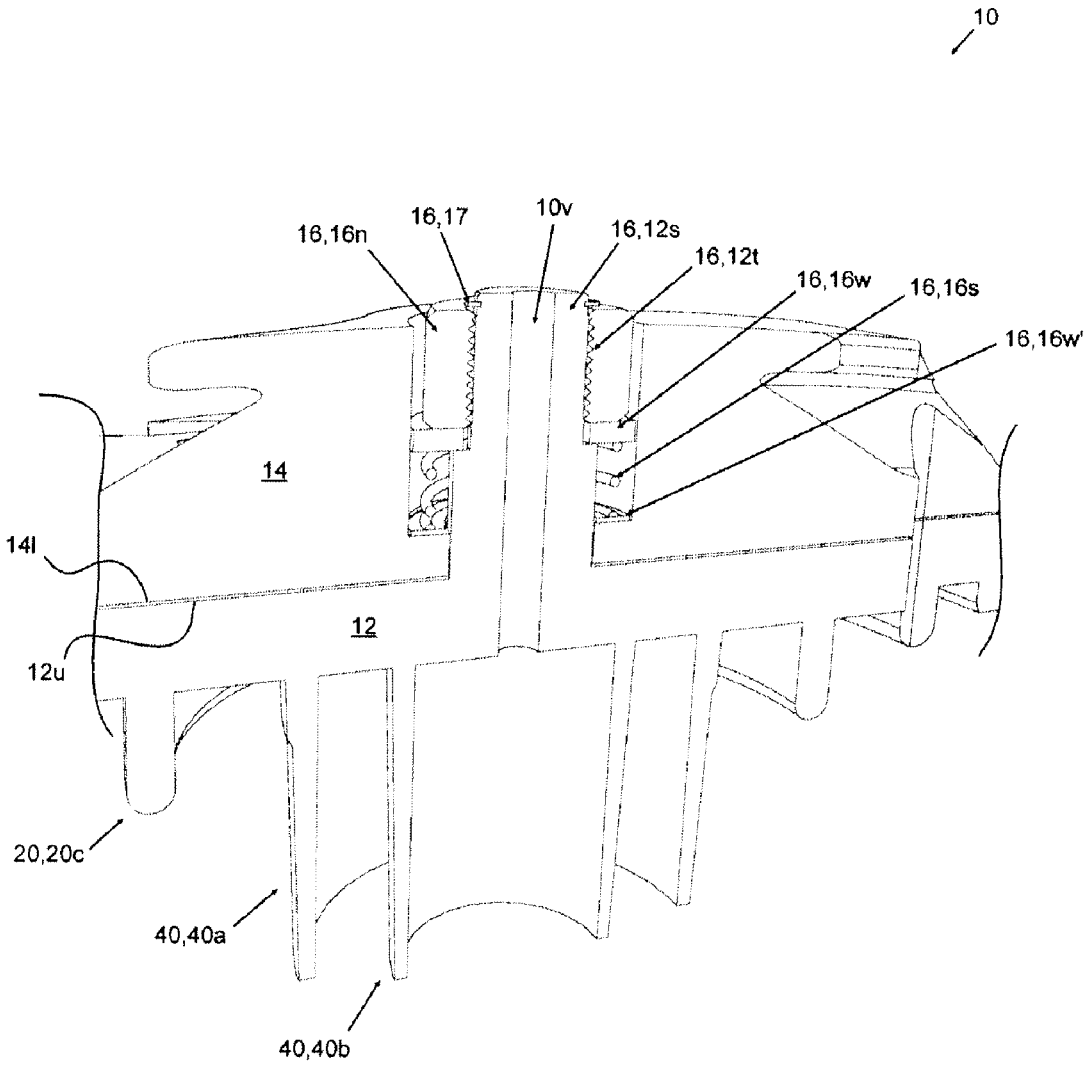
FIG. 5*c* is a cross-sectional perspective view of the cover assembly of FIG. 1*a* taken along line A-A in FIG. 3*a;*

In this embodiment, pivot means 16 comprises an axial shaft portion 12*s* projecting upwardly from, and integral with, the upper surface 12*u* of the base member 12 and an axial opening 14*o* through the pivoting member 14, said axial opening 14*o* of sufficient diameter to accept the axial shaft portion 12*s* therethrough and further having a upper axial cavity 14*w* that is of a larger diameter than said axial opening 14*o* thereby forming ledge or shoulder 14*h* (see FIGS. 5*b* and 5*c*). Other embodiments of pivot means 16 may be utilized, including conventional pivot means typically used to pivotally join two generally circular and planar members together.

In this embodiment, pivot means 16 further comprise an externally threaded distal end 12*t* on the axial shaft portion 12*s*, a compression coil spring 16*s* coaxially arranged around said shaft 12*s* and a nut 16*n* having an internally threaded opening to enable threadable engagement with the externally threaded distal end 12*t* and being of a diameter larger than the axial opening 14*o* but smaller than the diameter of the upper axial cavity 14*w* (see FIGS. 5*b* and 5*c*).

During operation, pivoting member 14 is placed over top of base member 12 so as to position axial shaft portion 12*s* to project through axial opening 14*o* (see FIG. 5*b*). Compression coil spring 16*s* is then placed over shaft 12*s* and nut 16*n* is threaded over the externally threaded distal end 12*t* (see FIG. 5*c*). The compression force of the compression coil spring 16*s*, once the nut 16*n* is threaded over the externally threaded distal end 12*t*, then forces the pivoting member 14 against base member 12 while still allowing co-axially pivoting movement P, P' of said base member 12 and pivoting member 14 relative to each other.

Preferably, pivoting means 16 further comprises washers 16*w*, 16*w*' positioned between the nut 16*n* and the compression coil spring 16*s* and between the compression coil spring 16*s* and shoulder 14*h*. Advantageously, washers 16*w*, 16*w*' facilitate smooth pivoting action of the base member 12 relative to the pivoting member 14. More preferably, pivoting means 16 further comprises snap ring groove 12*g* on the externally threaded distal end 12*t* of the axial shaft portion 12*s* and snap ring 17. Advantageously, when used in a conventional manner, snap ring 17 fitted in snap ring groove 12*g* will secure the nut 16*n* and significantly reduce the chance of accidental unthreading of nut 16*n* from axial shaft portion 12*s*.

Both the base member 12 and the pivoting member 14 comprise a plurality of fingers 12*f*, 14*f* which extend from their periphery at substantially equal spaced apart intervals. The fingers 12*f*, 14*f* are of substantially equal width, and the spaces therebetween 12*sp*, 14*sp* are of sufficient dimensions, to accommodate a plurality of bolts 30 on a tubular member 11 having a first bolt pattern when base member 12 and pivoting member 14 are pivoted relative to each other so as to substantially overlap the fingers 12*f* of the base member 12 with the fingers 14*f* of the pivoting member 14 (see FIGS. 1*a*, 2*a*, 3*a*, 4*a*, 7*a*, 9*a* and 9*b*). The cover assembly 10 can then be referred to as being in an open configuration, due to the spaces 12*sp* being uncovered.

When base member 12 and pivoting member 14 are so pivoted or actuated relative to each other (so as to substantially overlap the fingers 12*f* of the base member 12 with the fingers 14*f* of the pivoting member 14), a plurality of bolts 30 are then positionable between said fingers 12*f*, 14*f* (as more clearly shown in FIGS. 9*a* and 9*b*) and the cover assembly 10 is then in a first bolt pattern configuration (see FIGS. 1*a*, 2*a*, 3*a*, 4*a*, 7*a*, 9*a* and 9*b*). In the current embodiment, the fingers 12*f*, 14*f* accommodate a 12 bolt pattern between themselves (as more clearly shown in FIGS. 9*a* and 9*b*). Advantageously, the plurality of bolts 30 placed between said fingers 12*f*, 14*f* provides stability to the cover assembly 10, facilitating secure placement of the cover assembly 10 on any tubular member 11 having such a first bolt pattern configuration.

As will be appreciated by those skilled in the art, other configurations and dimensions of fingers 12*f*, 14*f* and spaces 12*sp*, 14*sp* may be utilized in different embodiments to accommodate other bolt patterns (such as a 20 bolt pattern).

Preferably, both the base member 12 and the pivoting member 14 further comprise a plurality of bolt recesses 12*r*, 14*r*, located at the distal ends of the fingers 12*f*, 14*f* and of such shape and dimensions to accommodate a second bolt pattern when the base member 12 and the pivoting member 14 are pivoted relative to each other so as to substantially cover the spaces 12*sp* of the base member 12 with the fingers 14*f* of the pivoting member 14 (see FIGS. 1*b*, 2*b*, 3*b*, 4*b*, 7*b* and 9*c*-9*m*). The cover assembly 10 can then be referred to as being in a closed configuration, due overlap of fingers 14*f* over spaces 12*sp*.

Advantageously, when base member 12 and pivoting member 14 are so pivoted or actuated relative to each other (so as to substantially cover the spaces 12*sp* of the base member 12 with the fingers 14*f* of the pivoting member 14), a plurality of bolts 30 are then positionable against said bolt recesses 12*r*, 14*r* (as more clearly shown in FIG. 9*m*) and the cover assembly 10 is in a second bolt pattern configuration. In the current embodiment, the bolt recesses 12*r*, 14*r* accommodate a 16 bolt pattern when the cover assembly 10 is actuated, or pivoted, to the second bolt pattern configuration. Advantageously, the plurality of bolts 30 placed against said bolt recesses 12*r*, 14*r* and provide additional stability to the cover assembly 10 while covering the tubular member 11.

As will be appreciated by those skilled in the art, other configurations and dimensions of fingers 12*f*, 14*f*, spaces 12*sp*, 14*sp* and bolt recesses 12*r*, 14*r* may be utilized in different embodiments to accommodate other bolt patterns (such as a 24 bolt pattern).

Preferably, the cover assembly 10 further comprises at least one ring groove guide 20 projecting or extending from the lower surface 121 of the base member 12 so as to facilitate engagement of the cover assembly 10 with a ring groove 11*r* that may be present in a tubular member 11 that is flanged. Advantageously, when the cover assembly 10 is placed on a tubular member 11 that is flanged and has a ring groove 11*r*, the ring groove guide 20 will reduce the chance of any accidental damage to the ring groove 11*r*.

In the embodiment of FIGS. 1*a*-9*m*, the cover assembly 10 preferably comprises three generally circumferentially positioned ring groove guides 20*a*, 20*b*, 20*c* each of such shape, dimensions and diameter to engage the ring grooves of 13⅝ inch, 11 inch and 7 1/16 inch bore American Petroleum Institute (API) 6A flanges respectively. Other shapes, dimensions, diameters and number of ring groove guides may be utilized to accommodate and engage with different dimensioned flanges.

Figure 6A:
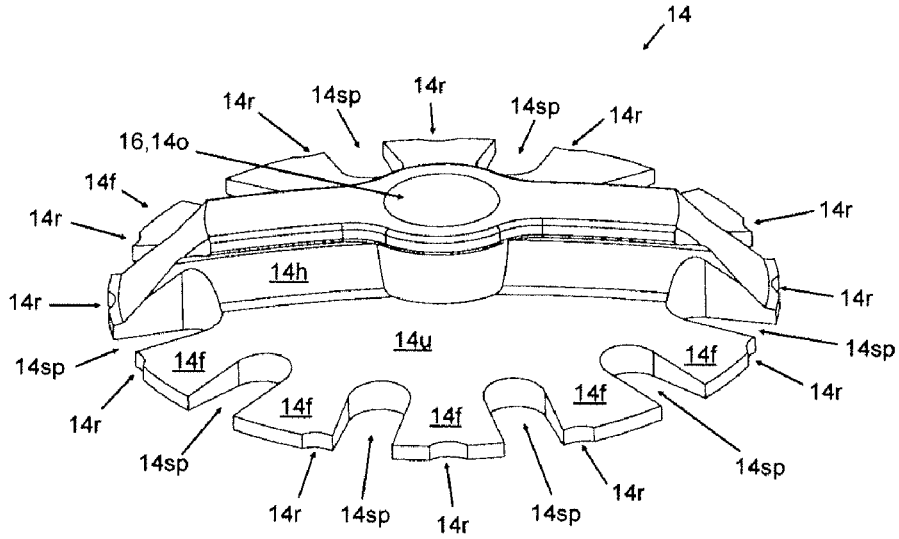
FIG. 6*a* is a top perspective view of a pivoting member of the cover assembly of the embodiment of FIG. 1*a;*
Figure 6B:
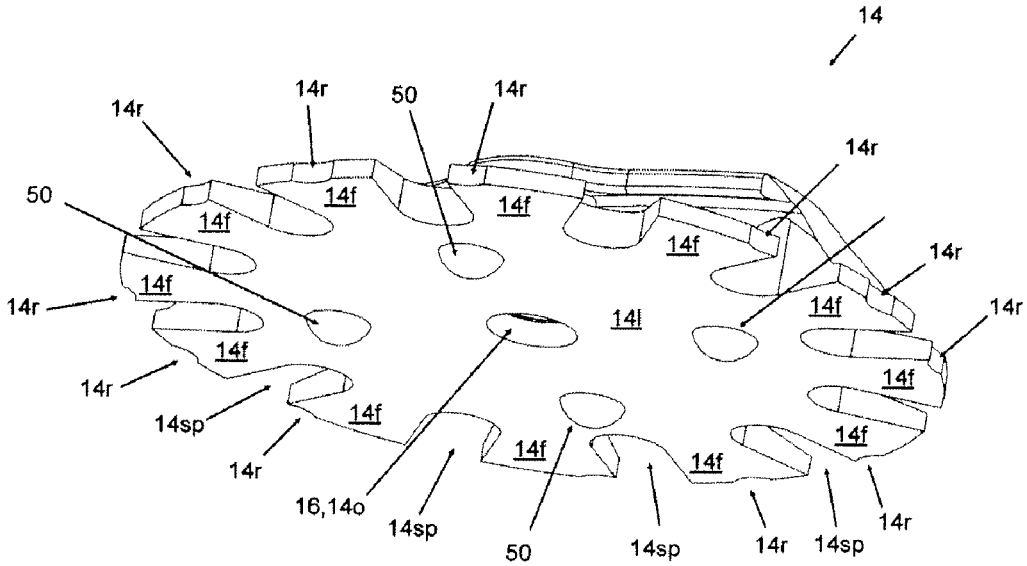
FIG. 6*b* is a bottom perspective view of the pivoting member of FIG. 6*a;*
Figure 6C:
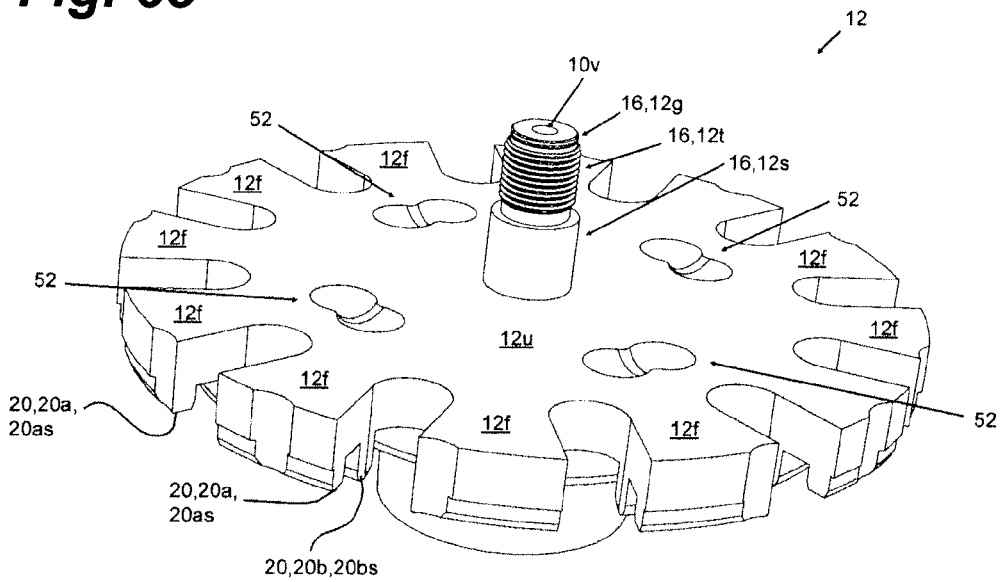
FIG. 6*c* is a top perspective view of a base member of the cover assembly of the embodiment of FIG. 1*a;*
Figure 6D:
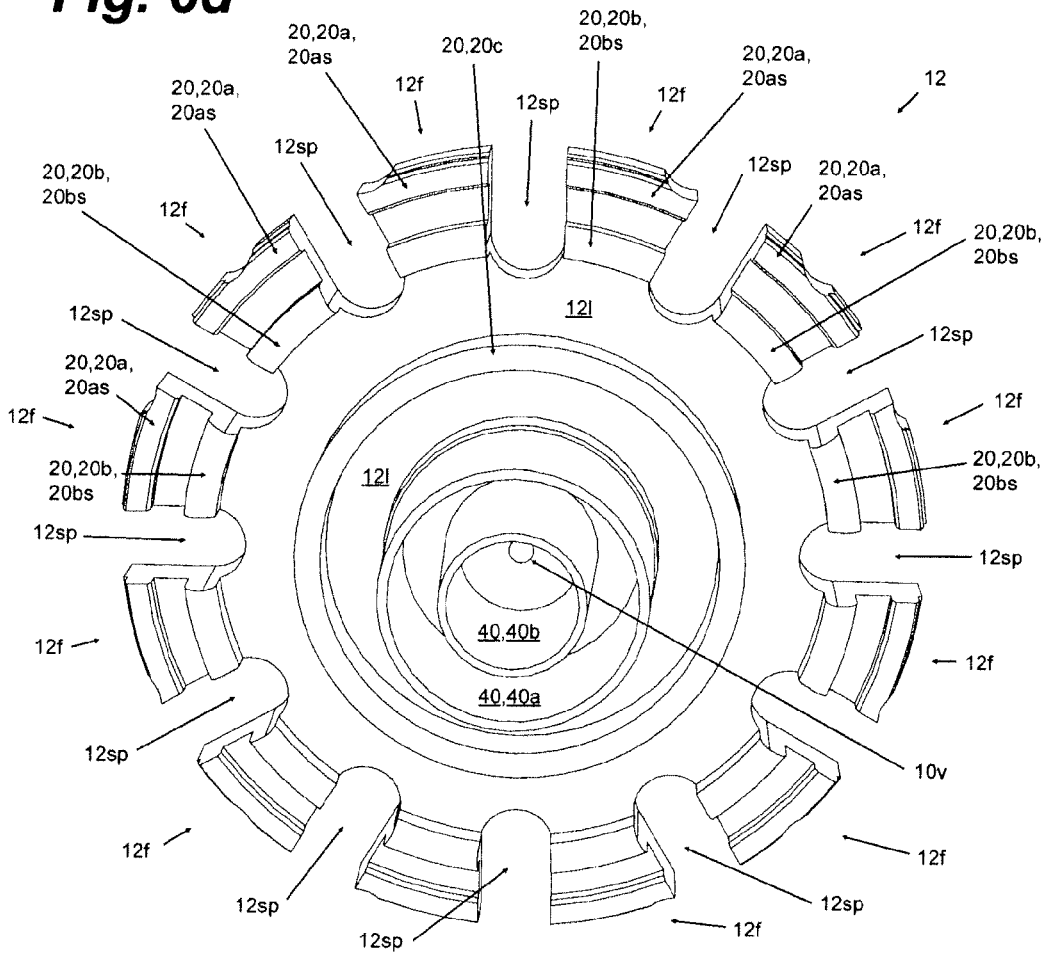
FIG. 6*d* is a bottom perspective view of the base member of FIG. 6*c;*
Figure 7A:
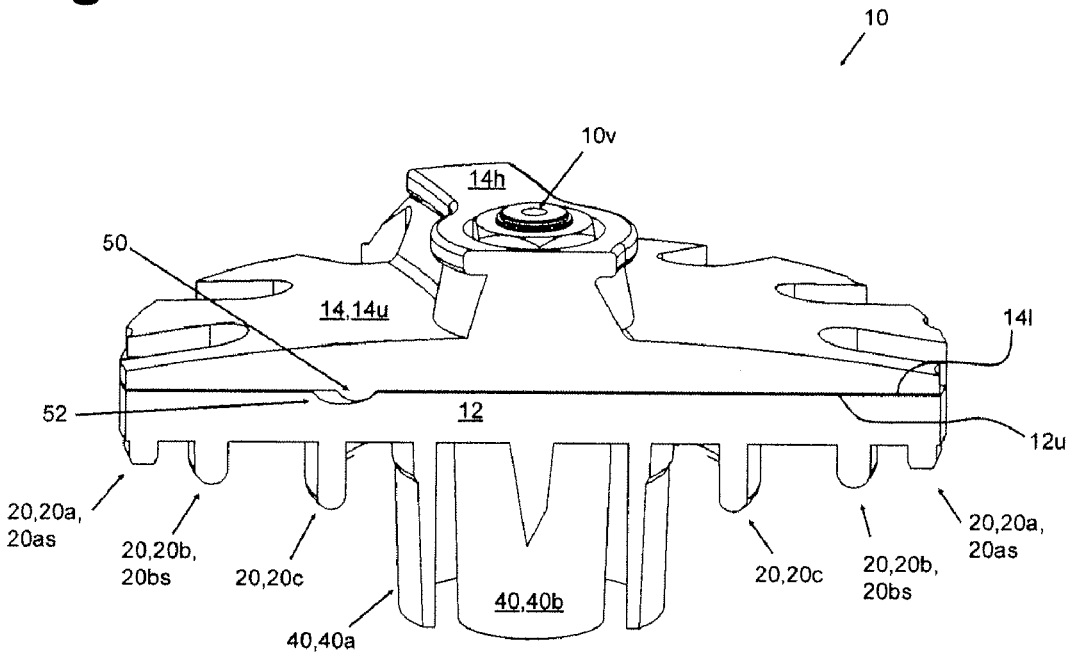
FIG. 7*a* is a cross-sectional perspective view of the cover assembly of FIG. 1*a* taken along line C-C in FIG. 3*a* and shown in a first bolt pattern configuration.
Figure 7B:
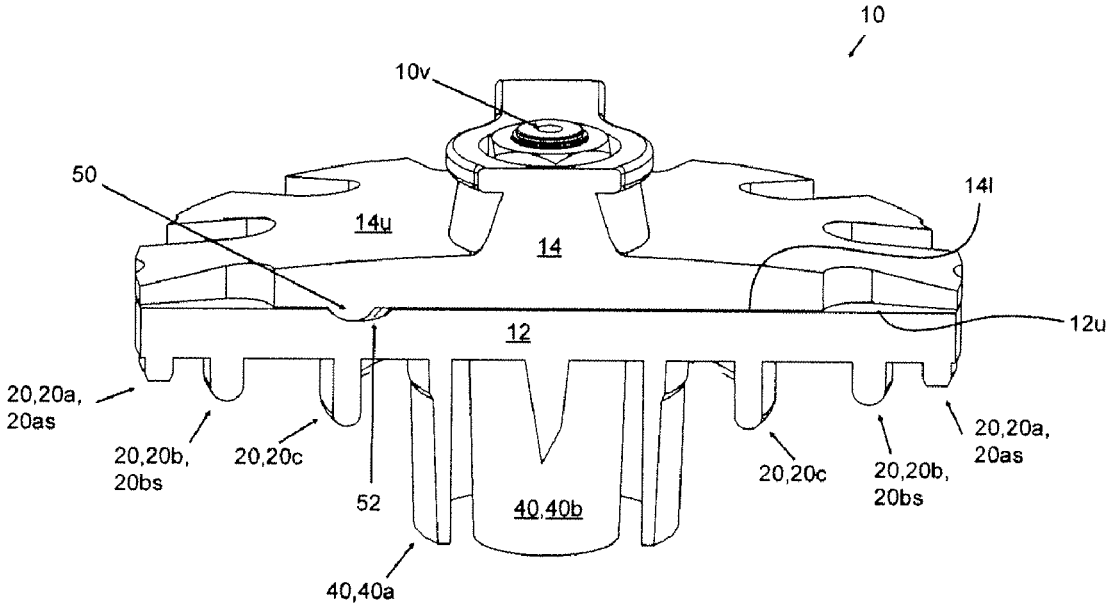
FIG. 7*b* is a cross-sectional perspective view of the cover assembly of FIG. 1*a* taken along line D-D in FIG. 3*b* and shown in a second bolt pattern configuration.
Figure 8A:
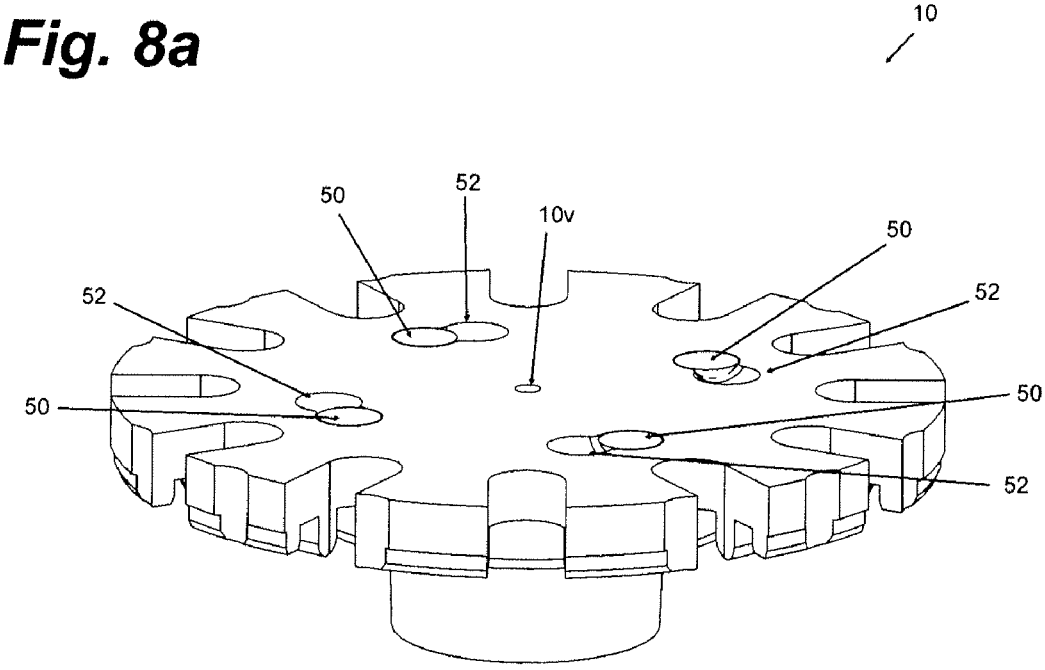
FIG. 8*a* is a planar-sectional perspective view of the cover assembly of FIG. 1*a* taken along line E-E in FIG. 4*a* and shown in a first bolt pattern configuration.
Figure 8B:
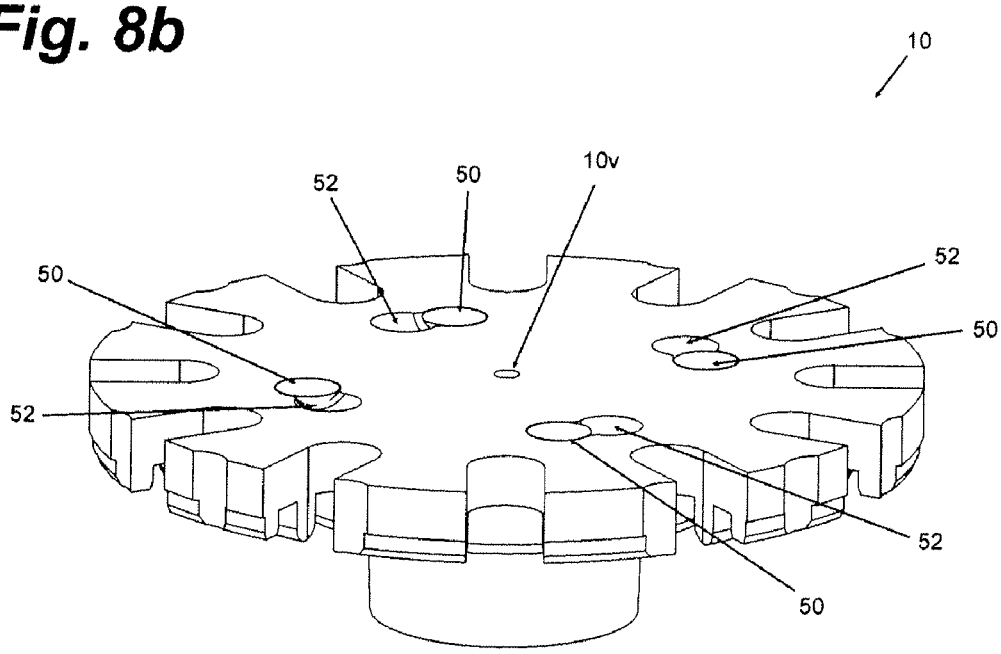
FIG. 8*b* is a planar-sectional perspective view of the cover assembly of FIG. 1*a* taken along line F-F in FIG. 4*b* and shown in a second bolt pattern configuration.

Further, in the embodiment of FIGS. 1*a*-9*m*, the two outermost ring groove guides 20*a*, 20*b* are preferably positioned on the lower surface 12*l* of the plurality of fingers 12*f* of the base member 12 and, therefore, are of an interrupted nature, with each of the ring groove guides 20*a*, 20*b* being comprised of a plurality of arc shaped segments 20*as*, 20*bs*, so as to accommodate or allow for the spaces 12*sp* between said fingers 12*f* (as more clearly shown in FIG. 6*d*). In the embodiment of FIGS. 1*a*-9*m*, the innermost ring groove guide 20*c*, is positioned on the lower surface 12*l* of the base member 12 and is therefore of a fully circular nature (as more clearly shown in FIG. 6*d*).

Advantageous, when the cover assembly 10 is in a closed configuration, with the fingers 14*f* of the pivoting member 14 overlapping or covering the spaces 12*sp* between the fingers 12*f* of the base member 12, even those portions of the ring groove 11*r* that are not directly covered or engaged by the arc shaped segments 20*as*, 20*bs* will still be protected by the fingers 14*f* of the pivoting member 14 to a significant extent, thereby reducing the chance of accidental damage to the ring groove 11*r*.

Preferably, the ring groove guides 20*a*, 20*b*, 20*c* each project or extend from the lower surface 12*l* of the base member 12 to a different degree, extent or height, with each successively peripheral ring groove guide being lower or smaller extent than the previous (more inner) ring groove guide. Advantageously, the cover assembly 10 can be easily and securely placed on a variety of flanged tubular members (each such tubular member having different dimensioned ring guides and different dimensioned internal bores).

FIGS. 9*c*-9*h* more clearly illustrate how the ring groove guides 20*a*, 20*b*, 20*c* of the cover assembly 10 of this embodiment each engage a differently dimensioned ring groove on a different sided flanged tubular member.

Figure 9A:
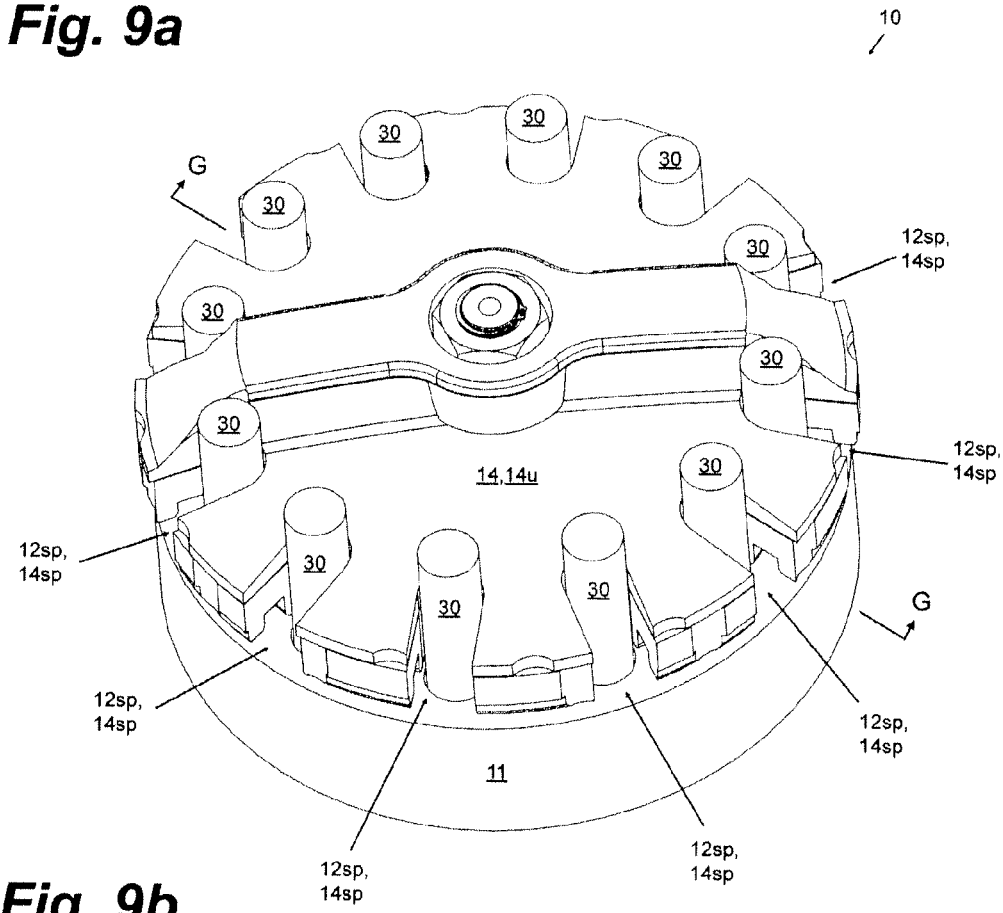
FIG. 9*a* is a top perspective view of the cover assembly of the embodiment of FIG. 1*a*, shown in a first bolt pattern configuration and positioned on a studded flange.
Figure 9B:
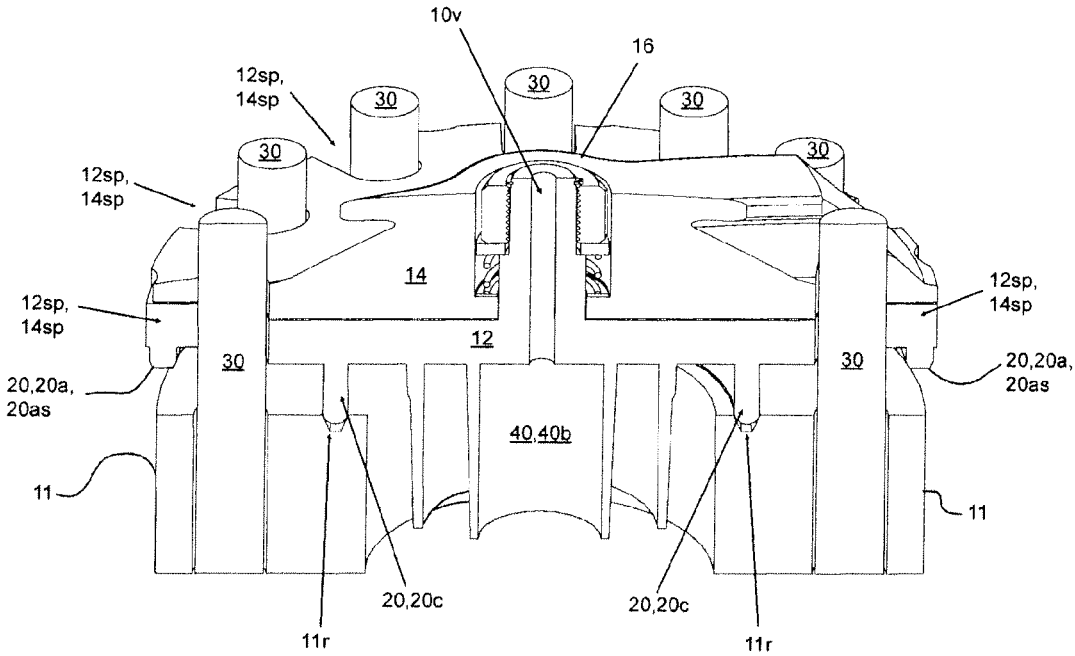
FIG. 9*b* is a cross-sectional perspective view of the cover assembly shown in FIG. 9*a*, taken along line G-G.
Figure 9C:
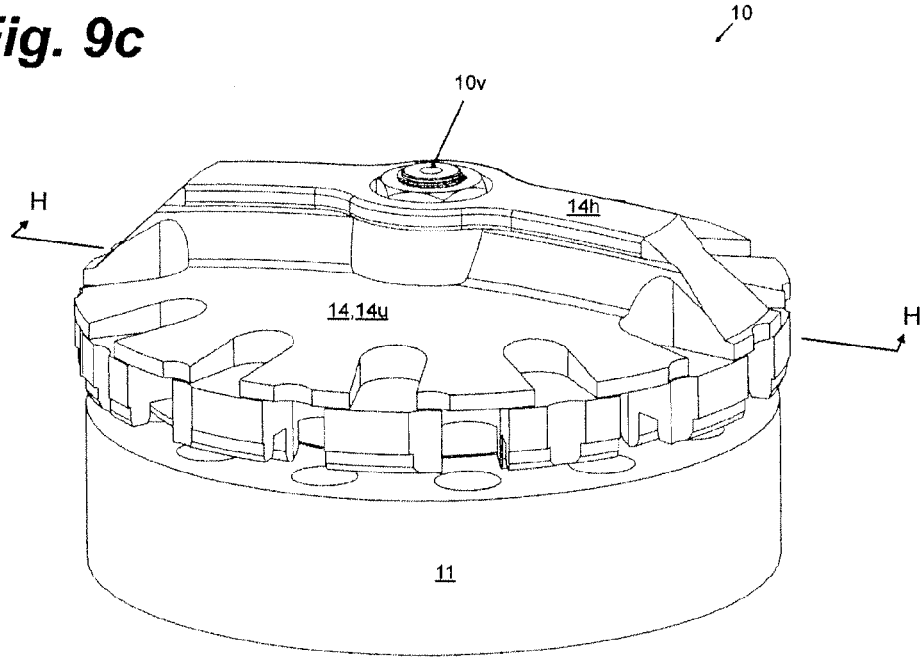
FIG. 9*c* is a top perspective view of the cover assembly of the embodiment of FIG. 1*a*, shown in a second bolt pattern configuration and positioned on a non-studded flange.
Figure 9D:
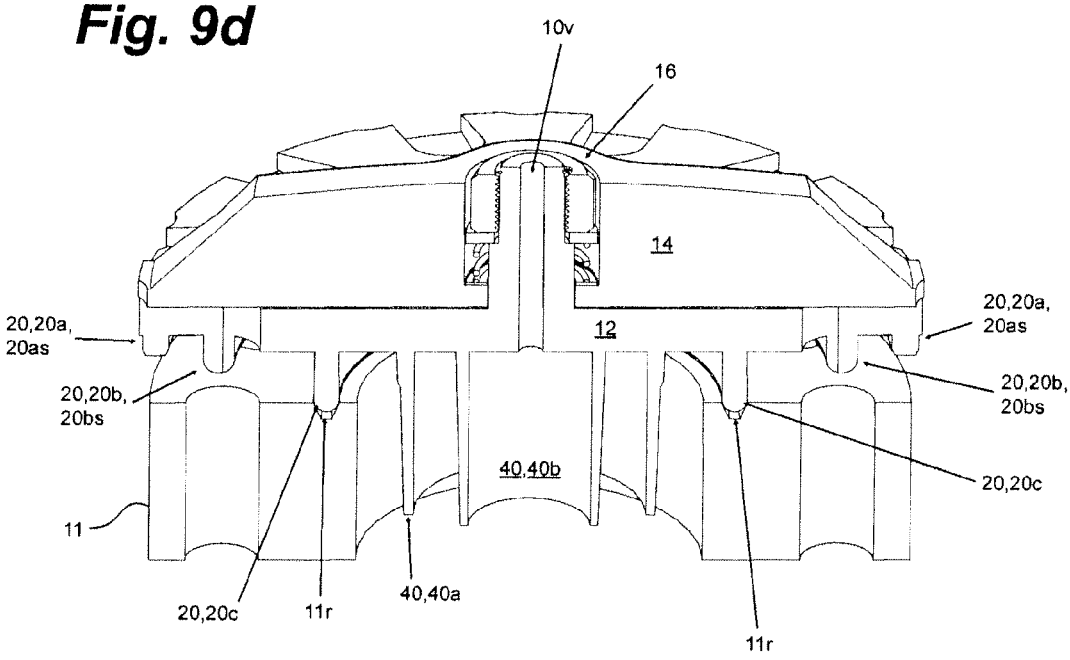
FIG. 9*d* is a cross-sectional perspective view of the cover assembly shown in FIG. 9*c*, taken along line H-H.

FIGS. 9*c*-9*d* illustrated how the cover assembly 10 sits on, or engages, a 7 1/16 inch bore American Petroleum Institute (API) 6A flange—with innermost ring groove guide 20*c* fitting on said ring groove 11*r* and with the other two ring groove guides 20*a*, 20*b* being of smaller height or extent, not being in contact with the flange of the tubular member 11 and therefore allowing the innermost ring groove guide 20*c* to fully seat in said ring groove 11*r*.

Figure 9E:
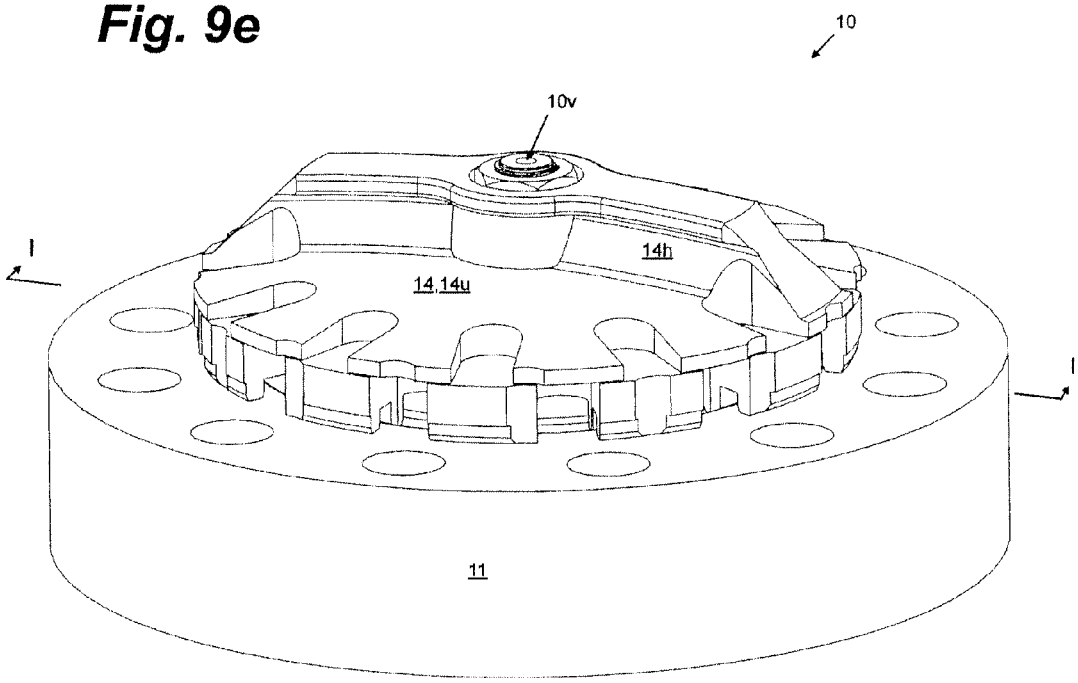
FIG. 9*e* is a top perspective view of the cover assembly of the embodiment of FIG. 1*a*, shown in a second bolt pattern configuration and positioned on a non-studded flange of larger diameter than the non-studded flange of FIGS. 9*c*-9*d;*
Figure 9F:
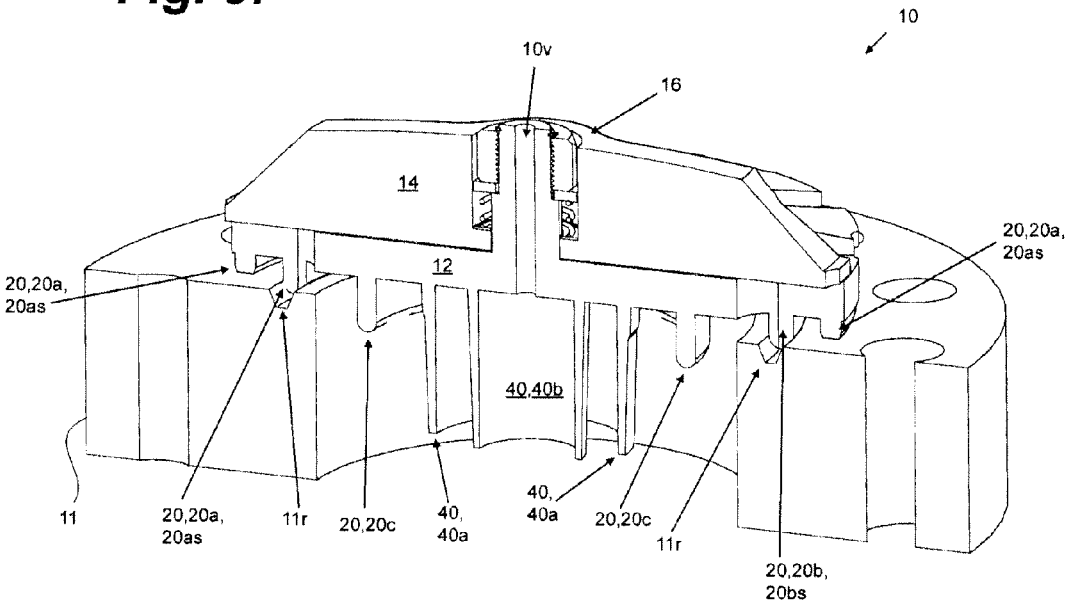
FIG. 9*f* is a cross-sectional perspective view of the cover assembly shown in FIG. 9*e*, taken along line I-I.

FIGS. 9*e*-9*f* illustrated how the cover assembly 10 sits on, or engages, an 11 inch bore American Petroleum Institute (API) 6A flange—with middle ring groove guide 20*b* fitting on said ring groove 11*r*, with innermost ring groove guide 20*c* being within the bore of said flange and with the outermost ring groove guide 20*a* being of smaller height or extent, not being in contact with the flange of the tubular member 11 and therefore allowing the middle ring groove guide 20*b* to fully seat in said ring groove 11*r*.

Figure 9G:
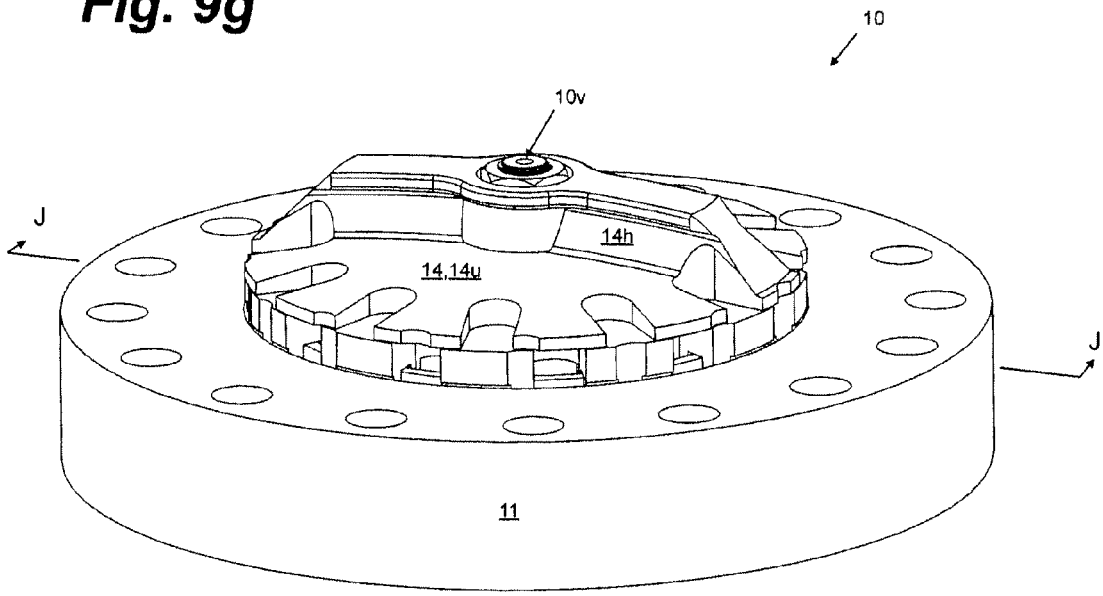
FIG. 9*g* is a top perspective view of the cover assembly of the embodiment of FIG. 1*a*, shown in a second bolt pattern configuration and positioned on a non-studded flange of larger diameter than the non-studded flanges of FIGS. 9*c*-9*f;*
Figure 9H:
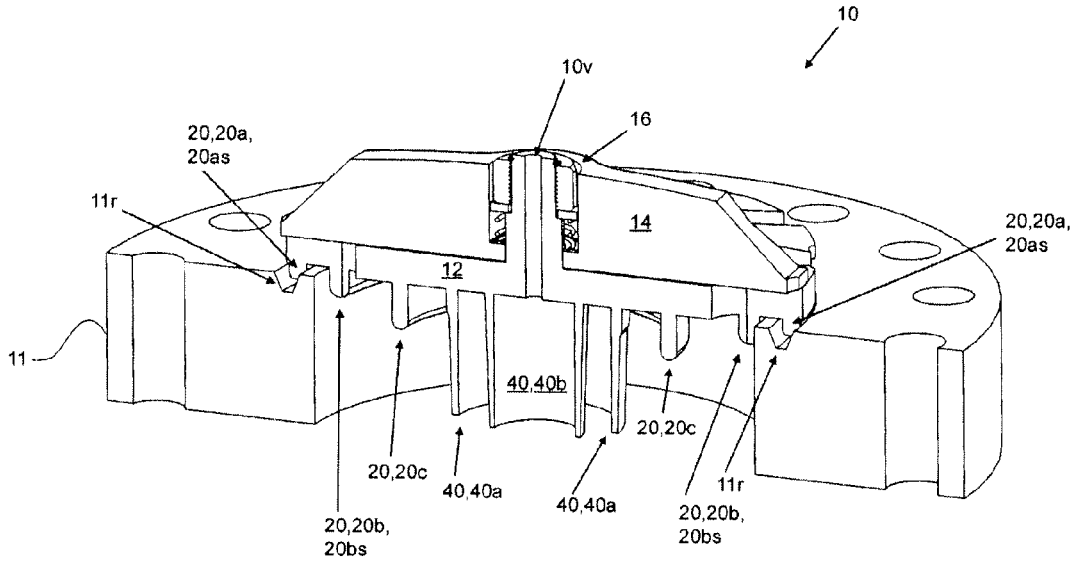
FIG. 9*h* is a cross-sectional perspective view of the cover assembly shown in FIG. 9*g*, taken along line J-J.
Figure 9I:
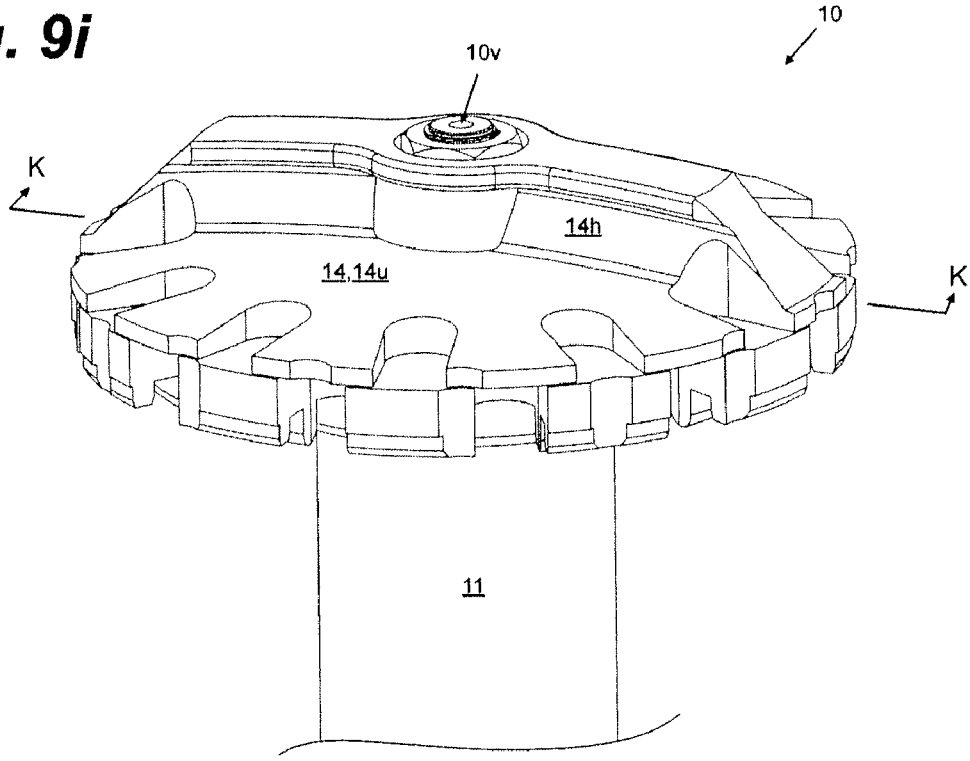
FIG. 9*i* is a top perspective view of the cover assembly of the embodiment of FIG. 1*a*, shown in a second bolt pattern configuration and positioned on a non-flanged tubular member.
Figure 9J:
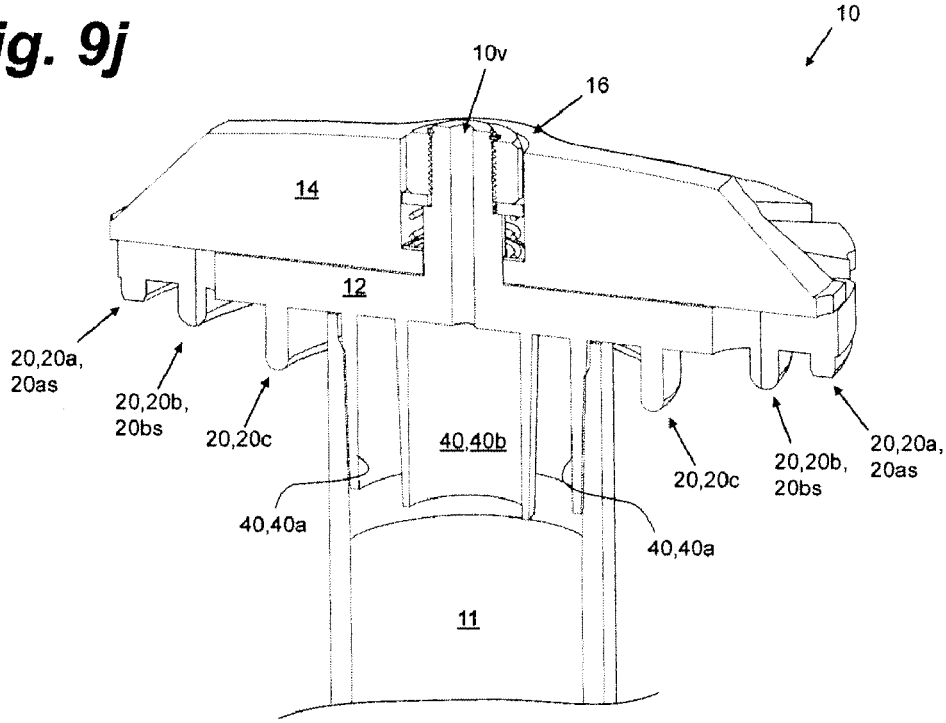
FIG. 9*j* is a cross-sectional perspective view of the cover assembly shown in FIG. 9*i*, taken along line K-K.
Figure 9K:
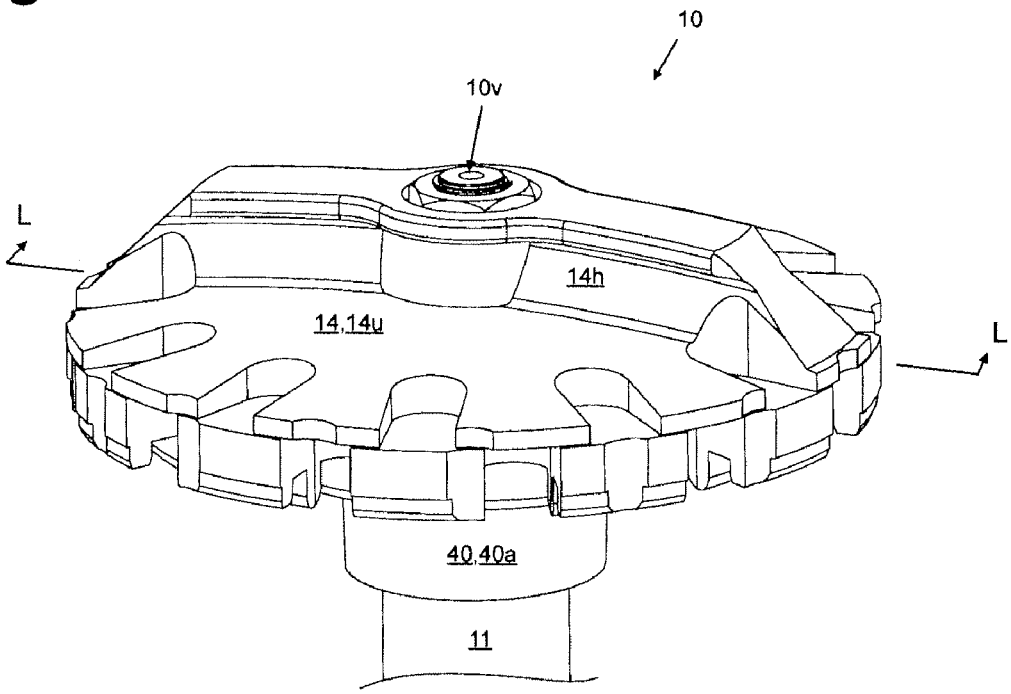
FIG. 9*k* is a top perspective view of the cover assembly of the embodiment of FIG. 1*a*, shown in a second bolt pattern configuration and positioned on a non-flanged tubular member of smaller diameter than the non-flanged tubular member of FIGS. 9*i*-9*j;*
Figure 9L:
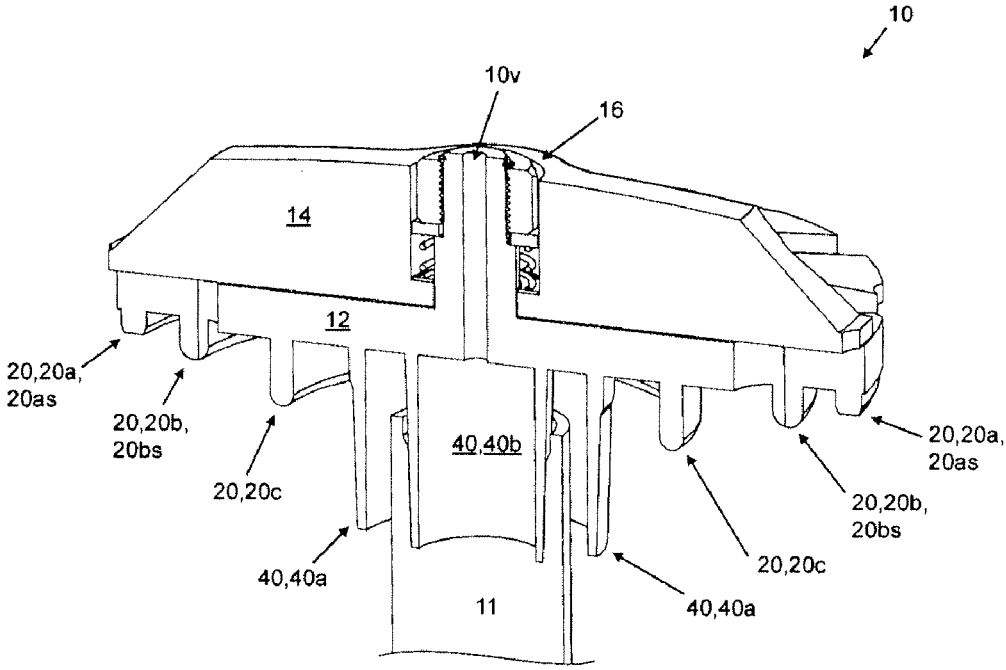
FIG. 9*l* is a cross-sectional perspective view of the cover assembly shown in FIG. 9*k*, taken along line L-L.
Figure 9M:
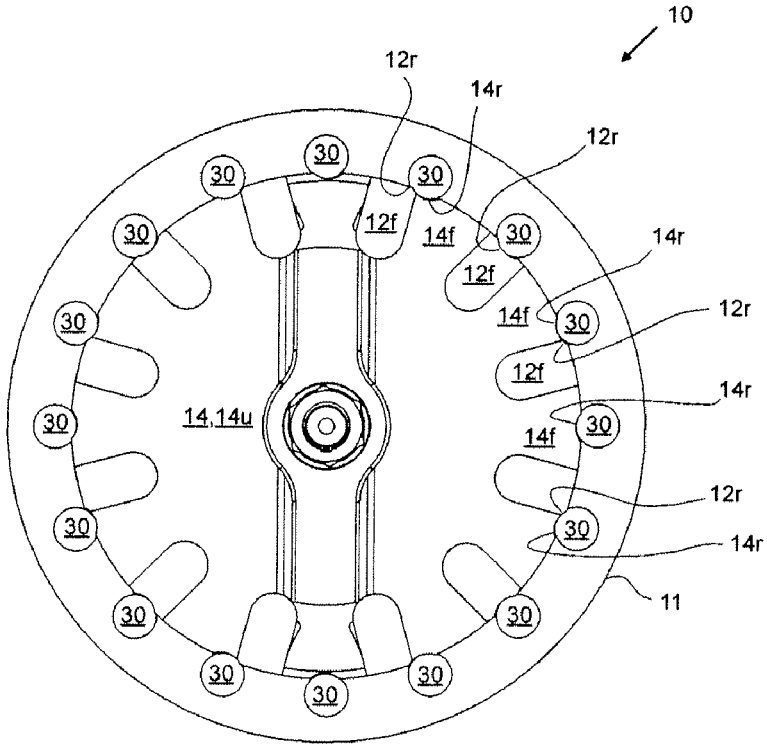
FIG. 9*m* is a top view of the cover assembly of the embodiment of FIG. 1*a*, shown in a second bolt pattern configuration and positioned on a studded flange of larger diameter than the studded flange of FIGS. 9*a*-9*b;*

FIGS. 9*g*-9*h* illustrated how the cover assembly 10 sits on, or engages, a 13⅝ inch bore American Petroleum Institute (API) 6A flange—with outer ring groove guide 20*a* fitting on said ring groove 11*r* and with the other two ring groove guides 20*b*, 20*c* being within the bore of said flange, therefore allowing the outer ring groove guide 20*c* to fully seat in said ring groove 11*r*.

Preferably, the cover assembly 10 further comprises at least one tubular engagement member 40 projecting or extending from the lower surface 12*l* of the base member 12 so as to facilitate engagement, or placement, of the cover assembly 10 with, or on, a tubular member 11 that is non-flanged and non-studded.

In the embodiment of FIGS. 1*a*-9*m*, the cover assembly 10 preferably comprises two, generally cone shaped and tapering, cylindrical engagement members 40*a*, 40*b* each of such shape, dimensions and diameter to engage a tubular member 11 having an approximate 5 inch inside diameter (such as 5½ inch outside diameter casing commonly found in an oil and gas well drilling setting) and a tubular member having an approximate 2⅞ inch inside diameter (such as EUE tubing or couplers) respectively. Other shapes, dimensions, diameters and number of cylindrical engagement members may be utilized to accommodate and engage with different dimensioned tubular members.

In this embodiment, cylindrical engagement member 40*a* is positioned outside and around cylindrical engagement member 40*b* and a space or annulus is created between said cylindrical engagement members 40*a*, 40*b*. Advantageously, the cover assembly 10 can be placed on one type of tubular member 11 (such as a 2⅞ inch inside diameter EUE tubing) using cylindrical engagement member 40*b* (see FIGS. 9*k*-9*l*) without the other cylindrical engagement member 40*a* interfering with such placement.

Further, in this embodiment, the ring groove guides 20*a*, 20*b*, 20*c* are positioned outside and around both cylindrical engagement members 40*a*, 40*b*. Advantageously, the cover assembly 10 can be placed on one type of tubular member 11 (such as a 2⅞ inch inside diameter EUE tubing) using cylindrical engagement member 40*b* (see FIGS. 9*k*-9*l*) or it can be place on another type of tubular member 11 (such as 5½ inch outside diameter casing) using cylindrical engagement member 40*a* (see FIGS. 9*i*-9*j*) without the ring groove guides 20*a*, 20*b*, 20*c* interfering with such placement.

Preferably, the cover assembly 10 further comprises at least one locking tab 50 and at least one tab recess 52 which cooperate together to lock the cover assembly 10 into either the open or closed configuration. In this embodiment, the cover assembly 10 preferably comprises four hemispherical convex locking tabs 50 evenly spaced on, and projecting from, the lower surface 14*l* of the pivoting member 14 (see FIG. 6*b*). Further in this embodiment, the cover assembly 10 preferably comprises four pairs of intersecting hemispherical concave tab recesses 52 carved out, impressed on, or sunken in, the upper surface 12*u* of the base member 12 (see FIG. 6*c*).

The positioning of both the locking tabs 50 and the tab recesses 52 is of such configuration that: (a) when the cover assembly 10 is in the open configuration, the locking tabs 50 are positioned within one hemisphere of the paired intersecting hemispherical concave tab recesses (see FIGS. 7*a* and 8*a*) and (b) when the cover assembly 10 is in the closed configuration, the locking tabs 50 are positioned within the other hemisphere of the paired intersecting hemispherical concave tab recesses 52 (see FIGS. 7*b* and 8*b*). Advantageously, the locking tabs 50 and tab recesses 52 cooperate together to keep the cover assembly 10 in either the open or closed configuration as may be desired while the cover assembly 10 is under the axial load of the compression coil spring 16*s*.

Another Embodiment of the Cover Assembly

Figure 10:
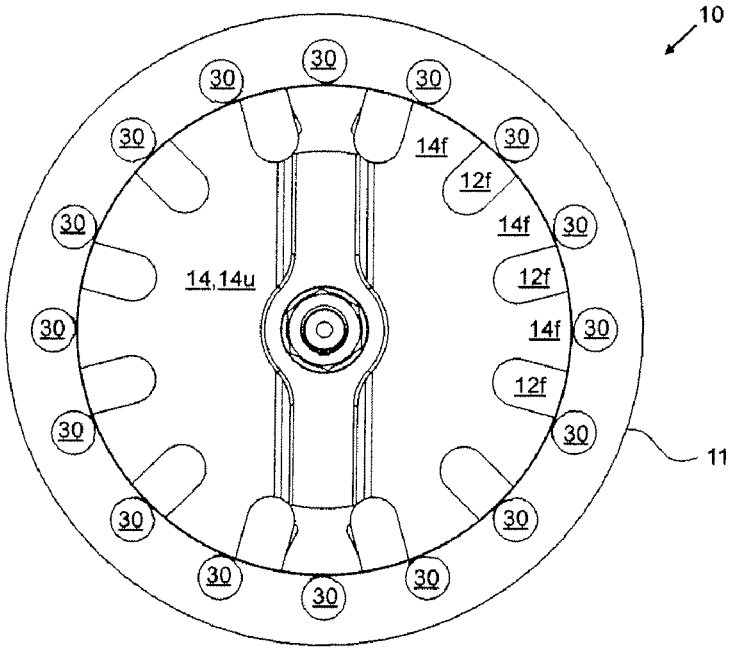
FIG. 10 is a top view of a cover assembly of another embodiment, shown in a second bolt pattern configuration and positioned on the studded flange of FIG. 9*m;*

FIG. 10 illustrates the configuration of another embodiment of the present invention. This embodiment is identical to that of FIGS. 1*a*-9*m* with the exception that there are no bolt recesses 12*r*, 14*r* on either the base member 12 or the pivoting member 14 and the outside diameter of the cover assembly is of such dimensions so as to fit within a plurality of bolts 30 that may be present on a tubular member 11.

Another Embodiment of Pivoting Means

Figure 11A:
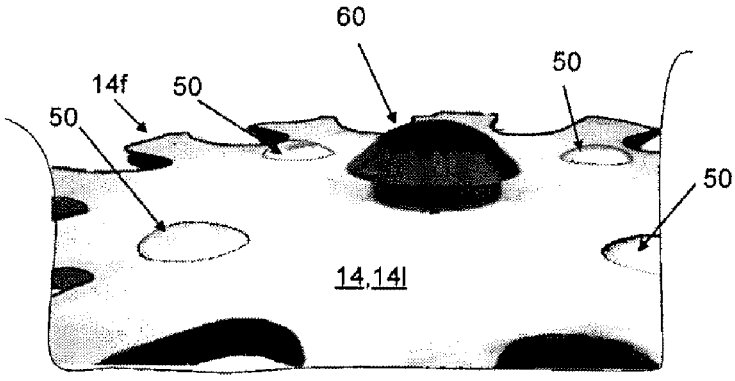
FIG. 11*a* is a perspective view of the lower surface of a pivoting member of yet another embodiment of the cover assembly.
Figure 11B:
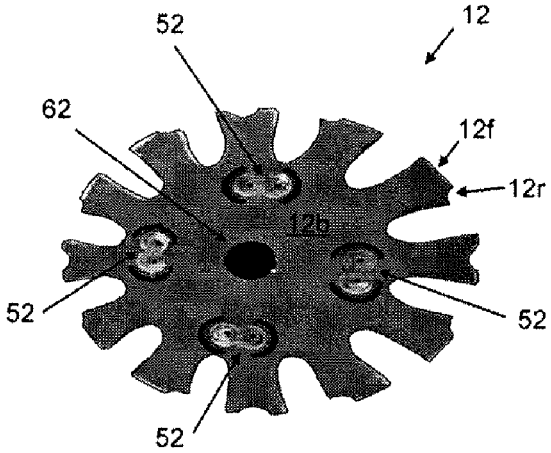
FIG. 11*b* is a perspective view of the upper surface of a base member of the embodiment of FIG. 11*a;*
Figure 12A:
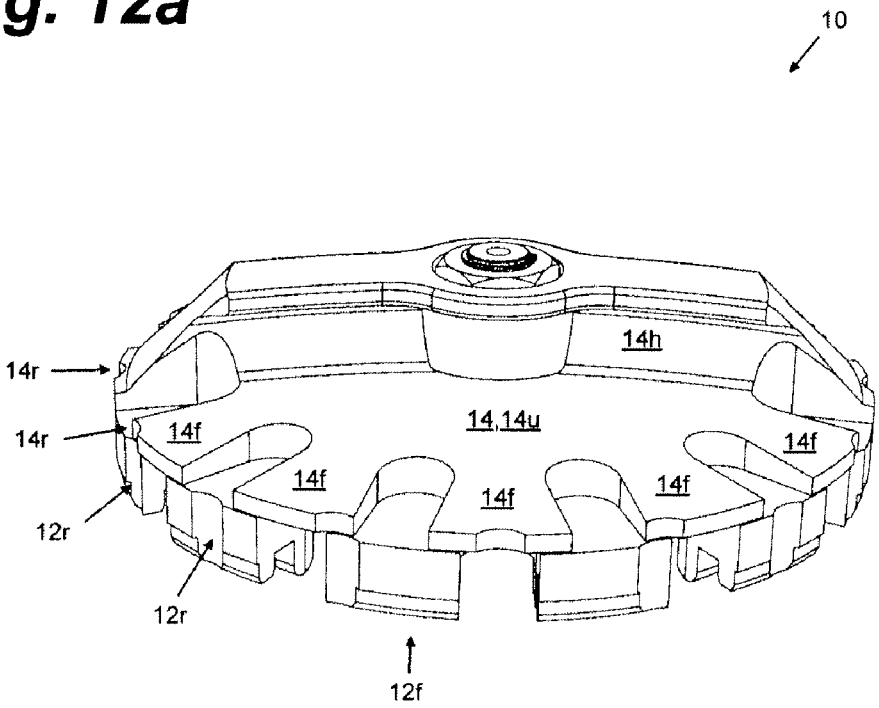
FIG. 12*a* is a top perspective view of yet another embodiment of a cover assembly.
Figure 12B:
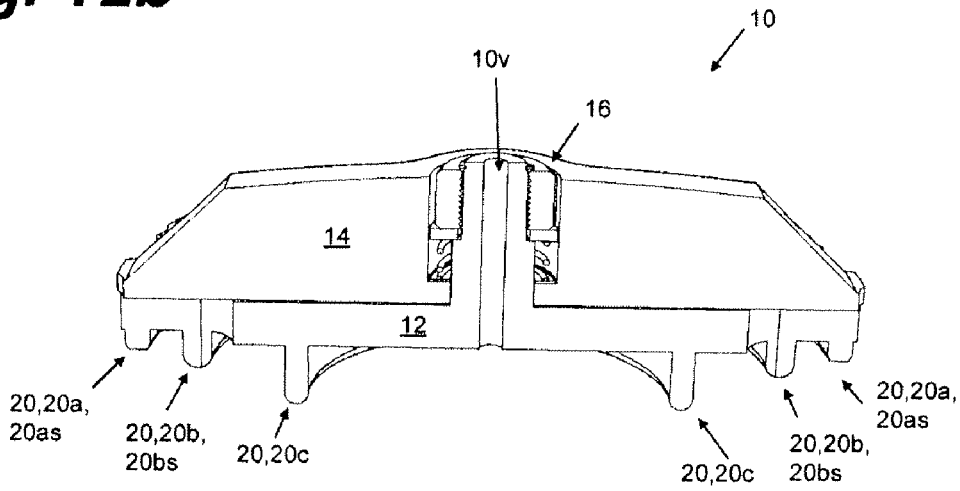
FIG. 12*b* is a cross-sectional perspective view of the cover assembly of in FIG. 12*a* and FIGS. 12*c*-12*d* are cross-sectional perspective views of the cover assembly of in FIG. 12*a* shown positioned on a non-studded and a studded tubular member respectively.
Figure 12C:
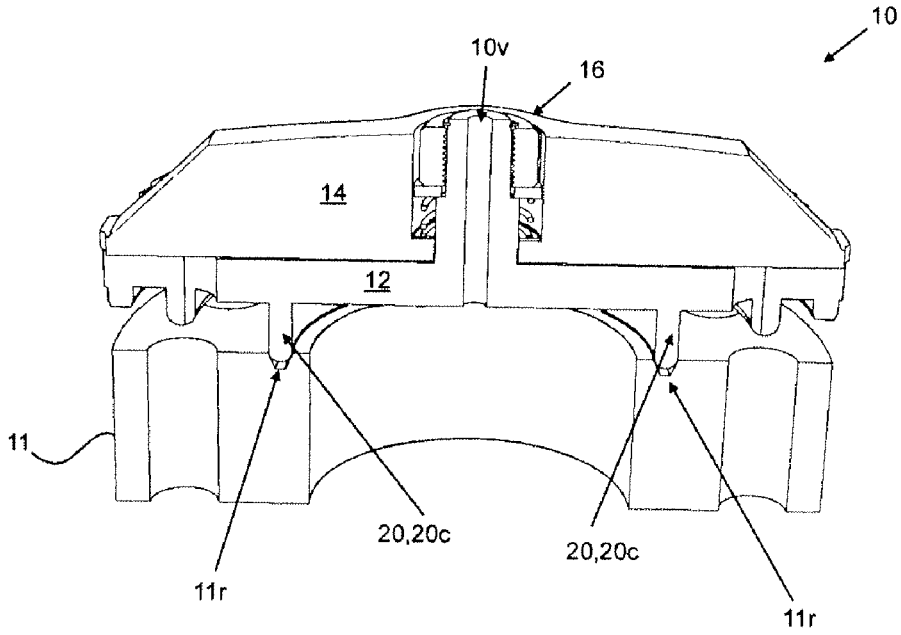
Figure 12D:
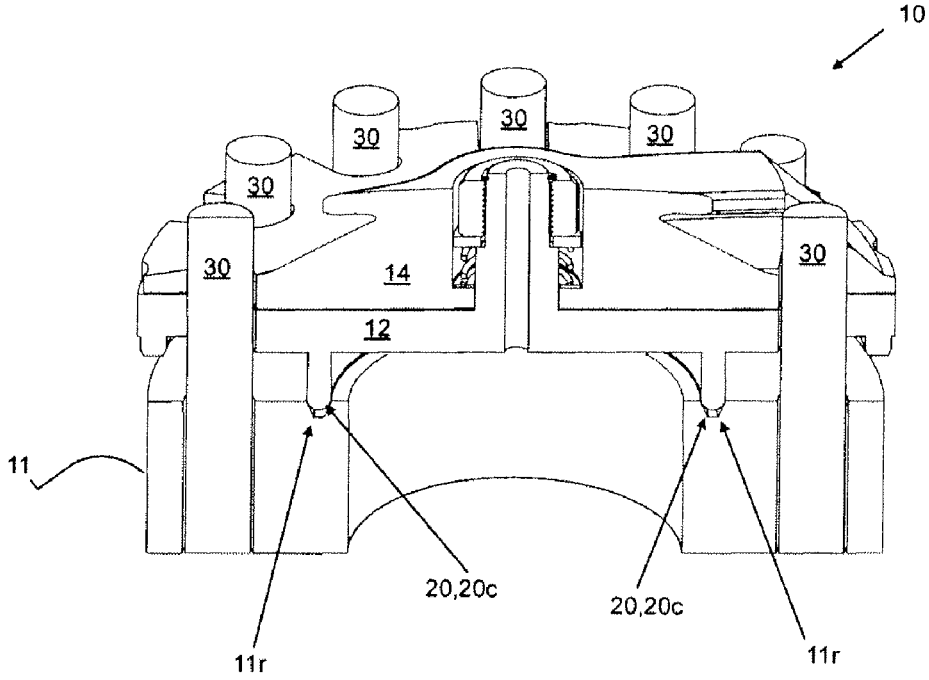

FIGS. 11*a* and 11*b* illustrate the configuration of another embodiment of the present invention. This embodiment is identical to that of FIGS. 1*a*-9*m* with the exception that the pivoting means 16 comprises an axial pivoting lug 60 extending or projecting from the lower surface 14*l* of the pivoting member and adapted for insertion into a corresponding axially located lug receiving hole 62 on the upper surface 12*u* of the base member 12. The base member 12 and pivoting member 14 are pivotally joined together in a conventional manner, by forcing pivoting lug 60 through lug receiving hole 62. Preferably, pivoting lug 60 further comprises an enlarged tapered head, so as to further secure the pivotal joint between base member 12 and pivoting member 14.

Yet Another Embodiment of the Cover Assembly

FIGS. 12*a*-12*d* illustrate the configuration of yet another embodiment of the cover assembly 10. This embodiment is identical to that of FIGS. 1*a*-9*m* with the exception that there are no tubular engagement members.

Those of ordinary skill in the art will appreciate that various modifications to the invention as described herein will be possible without falling outside the scope of the invention.

The embodiments of the invention in which an exclusive property or privilege is being claimed are defined as follows:

1. A cover assembly for a tubular member comprising:
- a base member;
- a pivoting member;
- a plurality of fingers extending from both the base member and the pivoting member; and
- pivot means to join said pivoting member to said base member in a co-axial pivoting alignment.

2. The cover assembly of claim 1 wherein the tubular member has a plurality of bolts and wherein the cover assembly is pivotable between a plurality of bolt pattern configurations, the cover assembly further comprising:
- a first set of spaces located between said plurality of fingers extending from the base member;
- a second set of spaces located between said plurality of fingers extending from the pivoting member;
- wherein the first set of spaces and the second sets of spaces are of sufficient dimensions to accommodate the plurality of bolts when the cover assembly is in at least one of said plurality of bolt pattern configurations.

3. The cover assembly of claim 1 wherein the plurality of fingers have distal ends and wherein the cover assembly further comprises bolt recesses at said distal ends.

4. The cover assembly of claim 1 further comprising at least one ring groove guide projecting from a lower surface of the base member.

5. The cover assembly of claim 1 further comprising at least one tubular engagement member projecting from a lower surface of the base member.

6. The cover assembly of claim 1 wherein the base member has an upper surface and a lower surface, the pivoting member has an upper surface and a lower surface and wherein, during pivoting motion, the upper surface of the base member remains in substantial abutting relation with the lower surface of the pivoting member and wherein, during pivoting motion, the pivoting member does not shift axially relative to the base member.

7. The cover assembly of claim 1 wherein the pivot means further comprises:
- an axial shaft portion projecting from the base member; and
- an axial opening in the pivoting member of sufficient diameter to accept the axial shaft.

8. The cover assembly of claim 1 wherein the pivot means further comprises:
- an axial pivoting lug projecting from the pivoting member; and
- an axial lug receiving hole in the base member of sufficient diameter to accept the axial pivoting lug.

9. The cover assembly of claim 1 wherein the cover assembly is pivotable between an open configuration and a closed configuration, the cover assembly further comprising:
- a first set of spaces located between said plurality of fingers extending from the base member; and
- a second set of spaces located between said plurality of fingers extending from the pivoting member;
- wherein, when the cover assembly is in the open configuration, the first and second sets of spaces substantially overlap and the fingers extending from the pivoting member substantially overlap with the fingers of the base member and wherein, when the cover assembly is in the closed configuration, the fingers extending from the pivoting member substantially overlap the first set of spaces.

10. A cover assembly for a tubular member pivotable between an open configuration and a closed configuration, wherein said open configuration accepts a first bolt pattern and wherein said closed configuration accepts a second bolt pattern the cover assembly comprising at least one ring groove guide.

11. The cover assembly of claim 10 further comprising at least one tubular engagement member.

12. A cover assembly for a tubular member having a plurality of bolts, the cover assembly pivotable between a plurality of bolt pattern configurations, said cover assembly comprising:

a base member;

a pivoting member;

a plurality of fingers extending from both the base member and the pivoting member;

pivot means to pivotally join said pivoting member to said base member;

a first set of spaces located between said plurality of fingers extending from the base member; and a second set of spaces located between said plurality of fingers extending from the pivoting member;

wherein the first set of spaces and the second sets of spaces are of sufficient dimensions to accommodate the plurality of bolts when the cover assembly is in at least one of said plurality of bolt pattern configurations.

13. The cover assembly of claim 12 wherein the plurality of fingers have distal ends and wherein the cover assembly further comprises bolt recesses at said distal ends.

14. The cover assembly of claim 12 further comprising at least one ring groove guide projecting from a lower surface of the base member.

15. The cover assembly of claim 12 further comprising at least one tubular engagement member projecting from a lower surface of the base member.

16. A cover assembly for a tubular member comprising:

a base member;

a pivoting member;

a plurality of fingers extending from both the base member and the pivoting member;

pivot means to pivotally join said pivoting member to said base member; and at least one ring groove guide projecting from a lower surface of the base member.

* * * * *